US010926391B2

(12) United States Patent
Jablonski et al.

(10) Patent No.: US 10,926,391 B2
(45) Date of Patent: Feb. 23, 2021

(54) POWERED FASTENER DRIVING TOOL HAVING HOOK ASSEMBLIES

(71) Applicant: Illinois Tool Works Inc., Glenview, IL (US)

(72) Inventors: David W. Jablonski, Wheaton, IL (US); Edward Eaton, Warrenville, IL (US); Brian Hurvitz, Warrenville, IL (US); Joey Lee, New Taipei (TW)

(73) Assignee: Illinois Tool Works Inc., Glenview, IL (US)

( * ) Notice: Subject to any disclaimer, the term of this patent is extended or adjusted under 35 U.S.C. 154(b) by 152 days.

(21) Appl. No.: 16/177,731

(22) Filed: Nov. 1, 2018

(65) Prior Publication Data

US 2019/0143499 A1 May 16, 2019

Related U.S. Application Data

(60) Provisional application No. 62/585,847, filed on Nov. 14, 2017.

(51) Int. Cl.

| | |
|---|---|
| ***B25C 7/00*** | (2006.01) |
| ***A45F 5/02*** | (2006.01) |
| ***B25C 1/10*** | (2006.01) |

(52) U.S. Cl.

CPC ..... *B25C 7/00* (2013.01); *B25C 1/10* (2013.01); *A45F 5/021* (2013.01); *A45F 2200/0575* (2013.01)

(58) Field of Classification Search

CPC ..... B25C 7/00; A45F 5/021

USPC ..... 224/163, 268, 904; 227/9

See application file for complete search history.

(56) References Cited

U.S. PATENT DOCUMENTS

| | | | | | |
|---|---|---|---|---|---|
| 976,638 | A | * | 11/1910 | Corey | A45B 9/00 135/65 |
| 3,286,315 | A | | 11/1966 | Price | |
| 3,478,550 | A | | 11/1969 | Salvesen | |
| D221,123 | S | | 7/1971 | Nicholas | |
| 4,214,688 | A | * | 7/1980 | Griffin, Jr. | A45F 5/00 224/197 |
| 4,406,064 | A | | 9/1983 | Goss | |
| 4,483,473 | A | | 11/1984 | Wagdy | |
| 4,522,162 | A | | 6/1985 | Nikolich | |
| 4,638,530 | A | | 1/1987 | Perry | |
| 4,645,104 | A | | 2/1987 | Vokaty | |

(Continued)

FOREIGN PATENT DOCUMENTS

| | | |
|---|---|---|
| DE | 102004032788 | 2/2006 |
| EP | 1 231 028 | 8/2002 |

(Continued)

OTHER PUBLICATIONS

AceTool, www.acetool.com, Senco PC0351 Nail Gun Belt Hook Tool Holder (Year: 2019) (1 page).

(Continued)

*Primary Examiner* — Gloria R Weeks

(74) *Attorney, Agent, or Firm* — Neal, Gerber & Eisenberg LLP

(57) ABSTRACT

A powered fastener driving tool, and particularly a powder-actuated tool, including in various embodiments both a pipe hook assembly including a pipe hook, and a belt hook assembly including a belt hook.

17 Claims, 18 Drawing Sheets

(56) References Cited

U.S. PATENT DOCUMENTS 4,677,362 A * 6/1987 House, II ..... H01M 10/46 320/115
4,787,145 A 11/1988 Klicker et al.
4,895,336 A * 1/1990 Lieberman ..... B25H 3/006 248/328
4,919,317 A 4/1990 Luedtke
5,224,230 A * 7/1993 Vanicsek ..... B23B 45/003 409/230
5,265,312 A * 11/1993 Okumura ..... B25F 5/00 224/269
D345,465 S * 3/1994 Greig ..... D3/215
5,372,206 A * 12/1994 Sasaki ..... B25B 21/00 173/178
5,452,835 A 9/1995 Shkolnikov
5,469,601 A * 11/1995 Jackson ..... A47J 45/10 16/421
D395,387 S * 6/1998 Snider ..... D8/68
5,810,232 A * 9/1998 Meurer ..... A45F 5/02 224/270
6,058,815 A * 5/2000 Habermehl ..... B25B 21/00 81/177.1
D426,125 S * 6/2000 Hayakawa ..... D8/61
6,145,724 A 11/2000 Shkolnikov et al.
6,161,256 A * 12/2000 Quiring ..... B25F 5/006 16/421
6,321,622 B1 11/2001 Tsuge
6,325,577 B1 * 12/2001 Anderson ..... A45F 5/02 206/350
D452,639 S * 1/2002 Zurwelle ..... D8/68
6,454,147 B1 * 9/2002 Marks ..... A45F 5/02 224/197
6,490,186 B2 * 12/2002 Cho ..... H01M 2/1022 363/146
6,543,664 B2 4/2003 Wolfberg
6,592,014 B2 7/2003 Smolinski
6,612,476 B2 9/2003 Smolinski
6,612,714 B1 * 9/2003 Morre ..... F21V 21/0885 362/191
6,641,011 B1 * 11/2003 Kahn ..... A45F 5/02 224/269
6,679,414 B2 1/2004 Rotharmel
6,695,192 B1 2/2004 Kwok
6,808,101 B2 10/2004 Laubach et al.
6,860,342 B1 * 3/2005 Wu ..... B25F 5/006 173/170
7,055,729 B2 6/2006 Taylor et al.
7,107,944 B1 9/2006 Heinzen
7,108,079 B2 * 9/2006 Sakai ..... B25B 21/02 173/122
D530,908 S 10/2006 Westcott
7,127,971 B1 10/2006 Braun
7,191,927 B2 3/2007 Segura
7,222,767 B1 5/2007 Yang
7,231,990 B2 * 6/2007 Lai ..... B25F 5/00 173/170
D546,558 S 7/2007 Albert
D554,963 S 11/2007 Holderfield et al.
7,306,052 B2 12/2007 Vahabi-Nejad et al.
7,308,290 B2 * 12/2007 Johnson ..... H04B 1/385 224/268
7,318,546 B2 1/2008 Segura et al.
7,320,422 B2 * 1/2008 Schell ..... B25C 1/005 173/170
7,341,172 B2 3/2008 Moore et al.
7,392,922 B2 7/2008 Vanstaan et al.
7,455,001 B1 11/2008 Waters
7,469,753 B2 * 12/2008 Klemm ..... F16D 7/08 173/178
7,478,740 B2 1/2009 Shea et al.
7,565,989 B2 * 7/2009 Lai ..... A45F 5/02 224/268
7,571,841 B2 8/2009 Gibson et al.
7,591,249 B2 9/2009 Wagdy et al.
7,654,429 B2 2/2010 Shea et al.
7,661,568 B2 2/2010 Vanstaan et al.
7,665,541 B2 * 2/2010 Sakai ..... B25B 21/02 173/122
7,681,661 B2 * 3/2010 Sakai ..... B25B 21/02 173/217
7,757,920 B2 7/2010 Shea et al.
D630,842 S 1/2011 Fonseca
D633,739 S 3/2011 Hamdia
7,942,299 B2 * 5/2011 Steinbrunner ..... B25C 7/00 224/269
7,999,507 B2 8/2011 Heinzen
8,016,046 B2 9/2011 Zhao et al.
8,074,855 B2 12/2011 Johnson
8,087,556 B2 1/2012 Oomori et al.
8,308,034 B2 11/2012 Shibata et al.
8,348,118 B2 1/2013 Segura
8,407,862 B2 4/2013 Bluma
8,443,913 B2 * 5/2013 Nagasaka ..... B25F 5/02 173/171
8,534,375 B2 * 9/2013 Matsumoto ..... B25F 5/02 16/110.1
8,960,635 B2 * 2/2015 Brendel ..... B25F 5/02 224/268
9,522,464 B2 12/2016 Segura et al.
D839,590 S 2/2019 Vedder
10,514,056 B2 * 12/2019 Emmerich ..... F16B 2/18
2002/0117531 A1 8/2002 Schell et al.
2002/0122707 A1 9/2002 Sakai et al.
2002/0179659 A1 * 12/2002 Shaw ..... A45F 5/021 224/269
2003/0132264 A1 7/2003 Smolinski
2003/0159251 A1 * 8/2003 Robinson ..... B25F 5/006 16/431
2005/0015935 A1 1/2005 Bader et al.
2006/0091168 A1 5/2006 Ng
2007/0080278 A1 4/2007 Wen
2007/0102176 A1 * 5/2007 Liao ..... B25F 5/00 173/170
2008/0185410 A1 8/2008 Oomori et al.
2009/0025515 A1 1/2009 Shibata et al.
2009/0134191 A1 * 5/2009 Phillips ..... A45F 5/02 224/269
2009/0277939 A1 11/2009 Ou
2009/0278012 A1 11/2009 Okouchi et al.
2011/0108300 A1 5/2011 Nagasaka et al.
2012/0023716 A1 2/2012 Bluma
2012/0292472 A1 11/2012 Segura et al.
2013/0043295 A1 2/2013 Gathers
2013/0062498 A1 3/2013 Ito et al.
2014/0097217 A1 * 4/2014 Walsh ..... A45F 5/021 224/268
2015/0040408 A1 2/2015 Francis et al.
2015/0122867 A1 5/2015 Segura
2015/0173498 A1 6/2015 Wang et al.
2015/0290791 A1 10/2015 Takahashi et al.
2017/0100835 A1 4/2017 Segura et al.
2017/0225309 A1 8/2017 Meyer

FOREIGN PATENT DOCUMENTS

| | | |
|---|---|---|
| EP | 1 327 500 | 7/2003 |
| EP | 1 862 264 | 12/2007 |
| EP | 2 022 607 | 2/2009 |
| EP | 2 308 652 | 4/2011 |
| JP | 2006116685 | 5/2006 |
| JP | 2006181709 | 7/2006 |
| JP | 200928841 | 2/2009 |
| JP | 201046739 | 3/2010 |
| WO | WO 2016/177795 | 11/2016 |

OTHER PUBLICATIONS

Paslode® Model PF350-S Strip Nailer Operating Manual and Schematic, Apr. 2009 (16 pages).

(56) References Cited

OTHER PUBLICATIONS

Image of Paslode® PowerMaster Plus, printed from http://ecs.images-amazon.com/images/1/71HV3XR5NTL.fig on Feb. 15, 2016 available prior to Feb. 10, 2016 (1 page).
Image of Paslode® Power Tool, available prior to Feb. 10, 2016, (1 page).
Image of Senco® Power Tool, available prior to Feb. 10, 2016, (1 page).
Image of Bostitch® Power Tool, available prior to Feb. 10, 2016, (1 page).
Image of Pneutools® Power Tool, available prior to Feb. 10, 2016, (1 page).
Image of Hitachi® Power Tool, available prior to Feb. 10, 2016, (1 page).
International Search Report and Written Report from International Application No. PCT/US2018/058857, dated Feb. 11, 2019 (13 page).

* cited by examiner

POWERED FASTENER DRIVING TOOL HAVING HOOK ASSEMBLIES

PRIORITY

This application claims priority to and the benefit of U.S. Provisional Patent Application Ser. No. 62/585,847, filed Nov. 14, 2017, the entire contents of which are incorporated herein by reference.

CROSS-REFERENCE TO RELATED APPLICATIONS

This application is related to the following commonly owned patent applications: U.S. application Ser. No. 29/625,982, entitled "FASTENER DRIVING TOOL PIPE HOOK,"; and U.S. application Ser. No. 29/625,985, entitled "FASTENER DRIVING TOOL BELT HOOK,".

BACKGROUND

Powered fastener driving tools are well known and commercially widely used throughout North America and other parts of the world. Powered fastener driving tools are typically electrically powered, pneumatically powered, combustion powered, or powder-actuated. Powered fastener driving tools are typically used to drive fasteners (such as nails, staples, and the like) to connect a first object, material or workpiece to a second object, material, or workpiece.

Various known powered fastener driving tools include: (a) a housing; (b) a power source or supply assembly in, connected to, or supported by the housing; (c) a fastener supply assembly in, connected to, or supported by the housing; (d) a fastener driving assembly in, connected to, or supported by the housing; (e) a trigger mechanism partially in, connected to, or supported by the housing; and (f) a workpiece contact element (sometimes referred to herein as a "WCE") connected to or supported by the housing. The WCE is configured to contact a workpiece and to operatively work with the trigger mechanism such that the WCE needs to be depressed or moved inwardly a predetermined distance with respect to the housing before activation of the trigger mechanism causes actuation of the power fastener driving tool.

As mentioned above, various known powered fastener driving tools are powder-actuated. Powder-actuated tools are typically used in construction and manufacturing to attach one or more objects to hard substrates (such as steel or concrete) using fasteners. Powder-actuated tools typically eliminate the need to drill holes with a concrete drill bit or to use anchors and screws for such fastening applications. For example, powder-actuated tools are commonly used by electricians to attach conduit clips, electrical junction boxes, and various other items to concrete, masonry, and steel surfaces.

Powder-actuated tools use a controlled explosion created by a small chemical propellant charge to propel the fastener through the objects or materials. Powder-actuated tools are typically either high velocity or low velocity. High velocity powder-actuated tools typically cause the propellant charge to act directly on or directly drive the fastener. Low velocity powder-actuated tools typically cause the propellant charge to act on a piston that in turn acts on or drives the fastener.

Like other powered fastener driving tools mentioned above, known powder-actuated tools typically have a housing that supports a trigger mechanism that must be actuated to cause the firing pin of the powder-actuated tool to reach the load to fire it. Various known powder-actuated tools also have a WCE element in the form of a muzzle safety interlock. If the muzzle is not pressed against a surface with sufficient force, the tool blocks the firing pin from reaching the load to fire it. This prevents the powder-actuated tool from discharging in an unsafe manner and from causing the fastener to become an undesired projectile. Various known powder-actuated tools have a power setting switch supported by the housing. The power setting switch enables the operator to set the amount of power of the tool (from a range of different power settings) or the amount of force at which the tool will propel or drive the fastener.

One issue with various known powered fastener driving tools (such as powder-actuated tools) is that the belt hook attached thereto is not satisfactory for one or more different reasons.

One such issue with certain known belt hooks attached to powered fastener driving tools is that the belt hook is connected to the tool in a rotatable manner that enables rotation or pivoting of the belt hook. In certain known tools, this allows the belt hook to sometimes be in an undesired position and possibly in the way of the desired operation of the tool.

A related issue with certain known belt hooks attached to powered fastener driving tools is that, when not in use, the belt hooks are not substantially out of the way and can get caught on or snagged on an object.

Another issue with certain known belt hooks attached to powered fastener driving tools is that certain operators tend to use the belt hooks to hang the tools on objects other than the operator's belt. Such objects include, for instance, scaffolding, pipes, and ladders and thus often have round or rounded surfaces. This can cause such known belt hooks to bend or break, and thus be unusable. This can also result in the tool falling off such objects, and possibly, breaking, becoming damaged, or injuring someone Another issue with certain known belt hooks attached to powered fastener driving tools is that they (and the mechanisms employed to attach them to the body or housing of the tool) add relatively significant weight to the fastener driving tool. It is well known that even a relatively small amount of additional weight added to such tools is undesired. More specifically, one issue with powered fastener driving tools arises due to repeated use of the tool by an operator. Many operators use powered fastener driving tools throughout the day on a regular or continuous basis as they are working. Many operators hold these tools for substantial parts of the day. Many operators pick up or lift and put down these tools numerous times throughout the day. Depending on the job or project the operator is working on, the operator may pick up and put down the tool dozens to several hundred times a day. Although various power actuated tools often weigh less than ten pounds, the continuous use and holding of these tools as well as the repetitive lifting and putting down of these tools can cause operator fatigue.

Accordingly, there is a need to provide a powered fastener driving tool that solves or addresses these problems.

SUMMARY

Various embodiments of the present disclosure provide a powered fastener driving tool that includes a first or pipe hook assembly and an independent or separate second or belt hook assembly that solve the above problems.

Various embodiments of the present disclosure provide a powered fastener driving tool (such as a powder-actuated tool) that generally includes: (a) a housing assembly including a main compartment assembly and a handle assembly extending from the main compartment assembly; (b) a power supply assembly positioned in or supported by the housing assembly; (c) a fastener supply assembly positioned in or supported by the housing assembly; (d) a fastener driving assembly positioned in the housing assembly; (e) a trigger mechanism assembly supported by the handle assembly; (f) a workpiece contact element assembly supported by the housing assembly; (g) a first or pipe hook assembly that includes a pipe hook rotatably attached to the housing; and (h) a second or belt hook assembly that includes a belt hook fixedly attached to the housing.

Various embodiments of the present disclosure also solve the above issues by providing the first or pipe hook assembly that includes a semi cylindrical or curved pipe hook connected to the housing in a rotatable manner that: (a) enables the pipe hook to be stored in a retracted locked position adjacent to and partially wrapped around the housing such that it does not interfere with operation of the tool; (b) substantially reduces the chance that the pipe hook can get caught on or snagged on an object when not in use; (c) can easily be moved or rotated to an extended locked position that enables the operator to hang the tool on an object besides the operator's belt such as scaffolding, pipes, and ladders without breaking and without falling off such objects; and (e) does not add significant weight to the tool, and thus minimizes operator fatigue.

Various embodiments of the present disclosure solve the above issues by also providing the independent and separate second or belt hook assembly that includes a belt hook connected to the housing in a fixed manner that: (a) does not interfere with operation of the tool; (b) substantially reduces the chance that the belt hook can get caught on or snagged on an object; (c) can be used to enable the operator to hang the tool on the operator's belt; and (d) does not add significant weight to the tool, and thus minimizes operator fatigue.

Various alternative embodiments of the present disclosure provide a belt hook assembly including a belt hook that is also moveable from a retracted position to an extended position.

Various embodiments of the present disclosure provide such a pipe hook assembly but not such a belt hook assembly.

Various embodiments of the present disclosure provide such a belt hook assembly but not such a pipe hook assembly.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
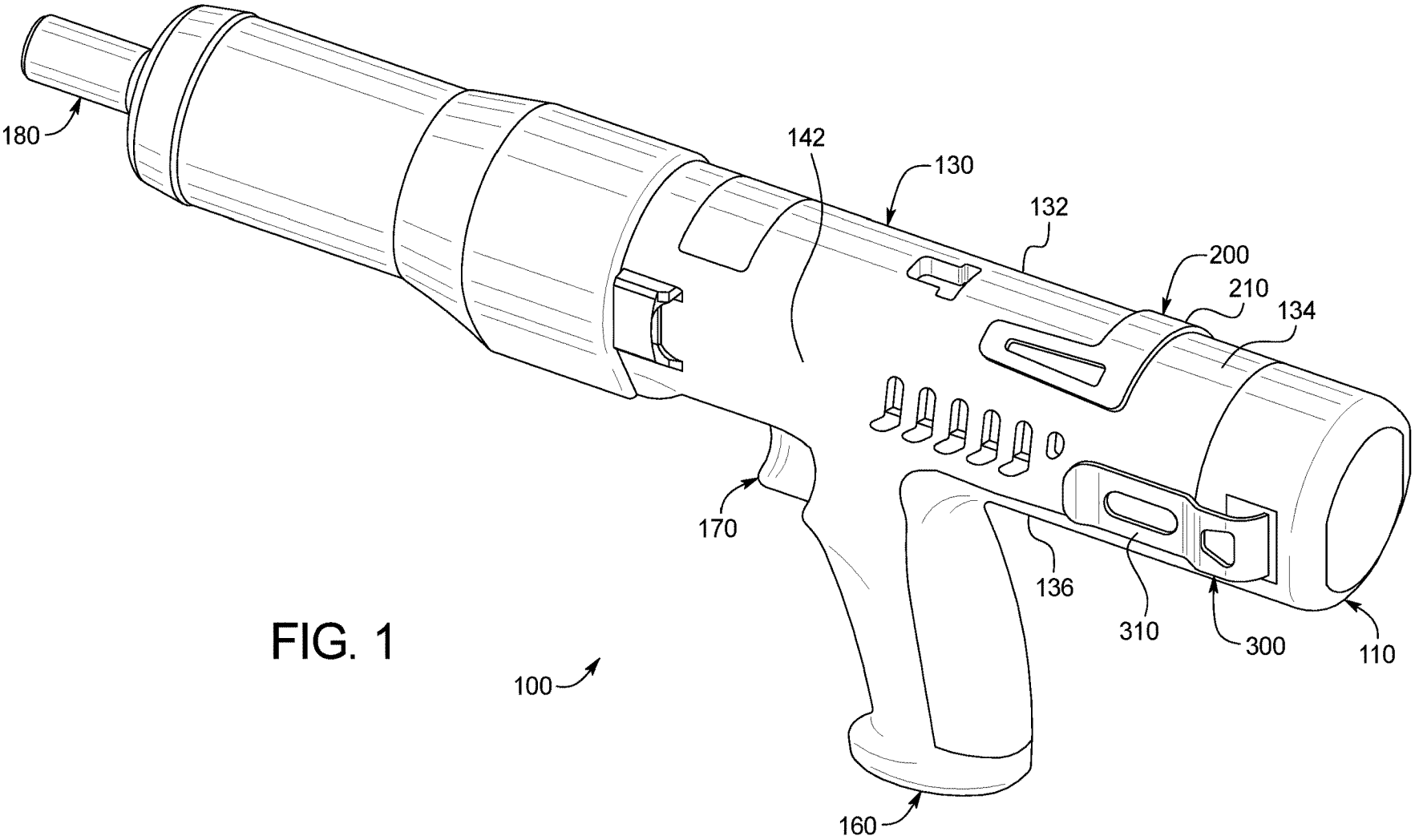
FIG. 1 is a left side perspective view of a powered fastener driving tool and particularly a powder-actuated tool of one example embodiment of the present disclosure, illustrating the rotatable pipe hook of the pipe hook assembly of the tool in a stored or retracted position, and illustrating the belt hook of the belt hook assembly of the tool in a fixed retracted position.

Referring now to the drawings, and particularly to FIGS. 1 to 16, the powered fastener driving tool of one example embodiment of the present disclosure is generally illustrated and indicated by numeral 100. The powered fastener driving tool in this illustrated example embodiment is a powder-actuated tool. This example powder-actuated tool may be referred to herein as the powered fastener driving tool, the fastener driving tool, the driving tool, or the tool for brevity. Such abbreviations are not meant to limit the present disclosure in any manner.

The powered fastener driving tool and particularly the powder-actuated tool 100 of this illustrated example embodiment generally includes: (a) a housing assembly 110 including a main compartment assembly 130 and a handle assembly 160 extending from the main compartment assembly 130; (b) a power source or supply assembly (not shown) positioned in the housing assembly 110 and configured to use loads (not shown) attached to a load strip (not shown) that is movable through the handle assembly 160 and main compartment assembly 130; (c) a fastener supply assembly (not shown) configured to receive fasteners (not shown) and positioned in the housing assembly 110; (d) a fastener driving assembly (not shown) positioned in the housing assembly 110; (e) a trigger mechanism assembly 170 (partially shown) connected to or supported by the handle assembly 160 of the housing assembly 110; (f) a WCE assembly 180 connected to or supported by the housing assembly 110; (g) a first or pipe hook assembly 200 including a pipe hook 210 rotatably attached to a first or right side of main compartment assembly 130 of the housing assembly 110; and (h) a different independent second or separate belt hook assembly 300 including a belt hook 310 fixedly attached to a second opposite side or left side of the main compartment assembly 130 of the housing assembly 110. It should be appreciated that first pipe hook assembly and the second different independent separate belt hook assembly can be attached to the housing at different locations than illustrated in FIGS. 1 to 16 (such as at opposite sides than shown in FIGS. 1 to 16).

More specifically, in this illustrated example embodiment, the housing assembly 110 includes a main compartment assembly 130 and a handle assembly 160 extending downwardly from the main compartment assembly 130. In this illustrated example embodiment, the main compartment assembly 130 includes an at least partially generally cylindrical generally tubular outer housing 132 including a top wall 134, a bottom wall 136, a first or right side wall 138, and a second or left side wall 142 integrally formed or connected. The housing assembly 110 including the main compartment assembly 130 and the handle assembly 160 may be made from various materials as is well known in the industry. It should be appreciated that the housing assembly 110 and the fastener driving related components therein can be in any suitable form in accordance with the present disclosure.

In this illustrated example embodiment, the pipe hook assembly 200 generally includes: (a) a pipe hook 210 rotatably attached to the right side wall 138 of the main compartment assembly 130 of the housing assembly 110; (b) a sleeve 250; (c) a first or front sleeve receiver 270 connected to or formed by or in the right side wall 138 of the main compartment assembly 130 of the housing assembly 110; (d) a second or rear receiver 280 also connected to or formed by or in the right side wall 138 of the main compartment assembly 130 of the housing assembly 110 at a spaced apart location; and (e) a spring 290. In this illustrated example embodiment, (a) the pipe hook 210 is made from a suitable metal; (b) the sleeve 250 is made from a suitable metal such as steel; (c) the first or front sleeve receiver 270 is made from a suitable plastic; (d) the second or rear receiver 280 is made from a suitable plastic; and (e) the spring 290 is made from a suitable metal. These components are all relatively light in weight. It should be appreciated that these components can be made from other suitable materials in accordance with the present disclosure.

The pipe hook 210 includes a multi-section multi-level pipe hook attachment shaft or hinge 212 and a multi-section at least partially curved hook 230 suitably connected to and extending from the pipe hook attachment shaft 212 as further described below. In this illustrated example embodiment, the multi-section pipe hook attachment shaft 212 is made from a suitable metal such as steel and the multi-section at least partially curved hook 230 is made from sheet metal. It should be appreciated that these components can be made from other suitable materials in accordance with the present disclosure.

The multi-section multi-level pipe hook attachment shaft or hinge 212 includes: (a) a multi-surface central body or central shaft member 214; (b) a generally cylindrical first front shaft member 216 integrally connected to and extending forwardly from the front end of the central body or shaft member 214; (c) a generally cylindrical locking pin 218 connected to and extending transversely from the first or front shaft member 216; (d) a generally cylindrical first rear shaft member 220 integrally connected to or formed with and extending rearwardly from the rear end of the central body or central shaft member 214; and (e) a generally cylindrical second rear shaft member 222 integrally connected to and extending rearwardly from the rear end of first rear shaft member 220. In this illustrated example embodiment, (a) the central body or central shaft member 214 has a greater outer diameter than the first front shaft member 216; (b) the first rear shaft member 220 has a same outer diameter as the central body or central shaft member 214; and (c) the first rear shaft member 220 has a greater outer diameter than the second rear shaft member 222.

The at least partially curved hook 230 includes: (a) a hooking base 231 at least partially wrapped around and securely connected to (such as by welding) the central body or central shaft member 214, the first or front shaft member 216, and first rear shaft member 220; (b) a hooking arm 232 integrally connected and extending from the hooking base 231; and (c) a hooking hand 238 integrally connected to the hooking arm 232. The hooking hand 238 includes a transversely extending hooking finger 240. In this illustrated example embodiment, the hooking finger 240 extends toward the forward end of the tool 100. The hooking arm 232 and the hooking hand 238 are rounded or curved to mate with the rounded or curved outer surface of the cylindrical generally tubular outer housing 132 of the main compartment assembly 130. The hooking arm 232 and the hooking hand 238 are also rounded or curved to mate with a rounded or curved outer surface of a pipe or other object on which the tool 100 can be hung as further described below.

Figure 13:
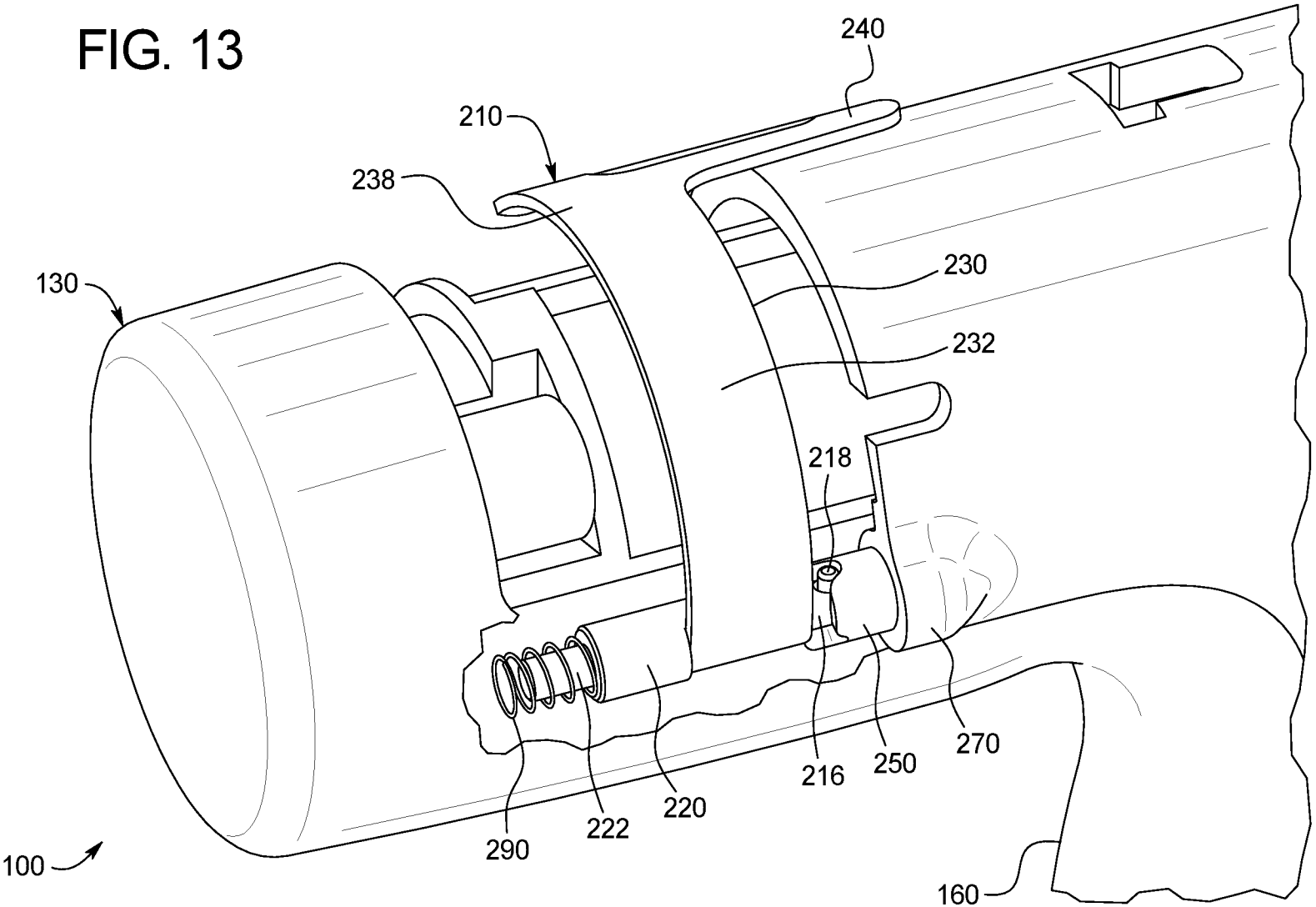
FIG. 13 is an enlarged fragmentary right side perspective view of the powder-actuated tool of FIG. 1, with part of the housing of the tool broken away and illustrating the pipe hook, the sleeve, and the spring of the pipe hook assembly, with the pipe hook in the stored or retracted position.

The sleeve 250 as best shown in FIGS. 9, 10, 11, and 12 includes a generally cylindrical tubular body including a generally cylindrical wall 252 having a first or front somewhat semi-cylindrical section, a second or rear generally cylindrical section, and a third or intermediate section. The first or front section, the second or rear section, and the third or intermediate section define or at last partially define a central channel 258 configured to receive part of the first front shaft member 216. The third or intermediate section includes a first wall section that partially defines a first locking pin receiving slot 260 and second wall section that partially defines a spaced apart second locking pin receiving slot 264. The third or intermediate section also includes a third wall section between the first wall section and the second wall section that includes a locking pin enagement or guide 262. The first locking pin receiving slot 260 is configured to receive the locking pin 218 when the pipe hook 210 is in the stored or retracted position as shown in FIG. 13. The second locking pin receiving slot 264 is configured to receive the locking pin 218 when the pipe hook 210 is in the in use or fully extended position as shown in FIG. 15. The locking pin enagement or guide 262 is configured to guide the locking pin 218 when the pipe hook 210 is moved: (a) from the stored or retracted position to the in use or fully extended position; or (b) from the in use or fully extended position to the stored or retracted position, as shown in FIG. 14.

In this illustrated example embodiment, the locking pin engagement or guide 262 includes a generally straight wall. In other embodiments, the locking pin engagement or guide 262 will be curved or have an apex such that when the locking pin 218 engages the locking pin engagement or guide 262, the locking pin engagement or guide 262 urges the locking pin 218 toward one of the first locking pin receiving slot 260 or the second locking pin receiving slot 264. This feature can be employed to cause a more automatic closing of the pipe hook 210. It should also be appreciated that other mechanisms can also be employed in accordance with the present disclosure to cause the automatic closing of the pipe hook 210 when the locking pin 218 is not secured in the second locking pin receiving slot 264.

Figure 3:
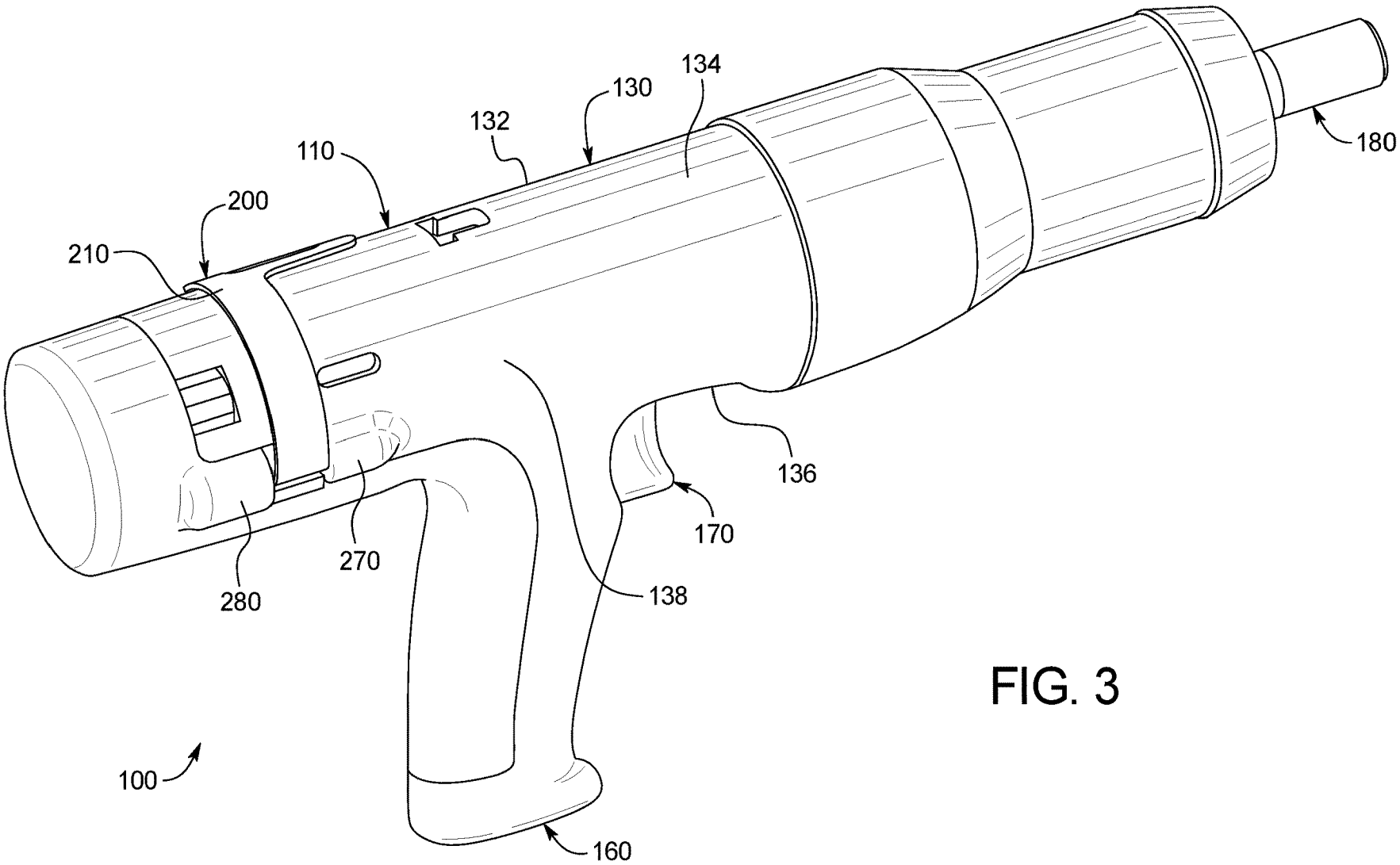
FIG. 3 is a right side perspective view of the powder-actuated tool of FIG. 1, illustrating the rotatable pipe hook of the pipe hook assembly of the tool in the stored or retracted position.
Figure 4:
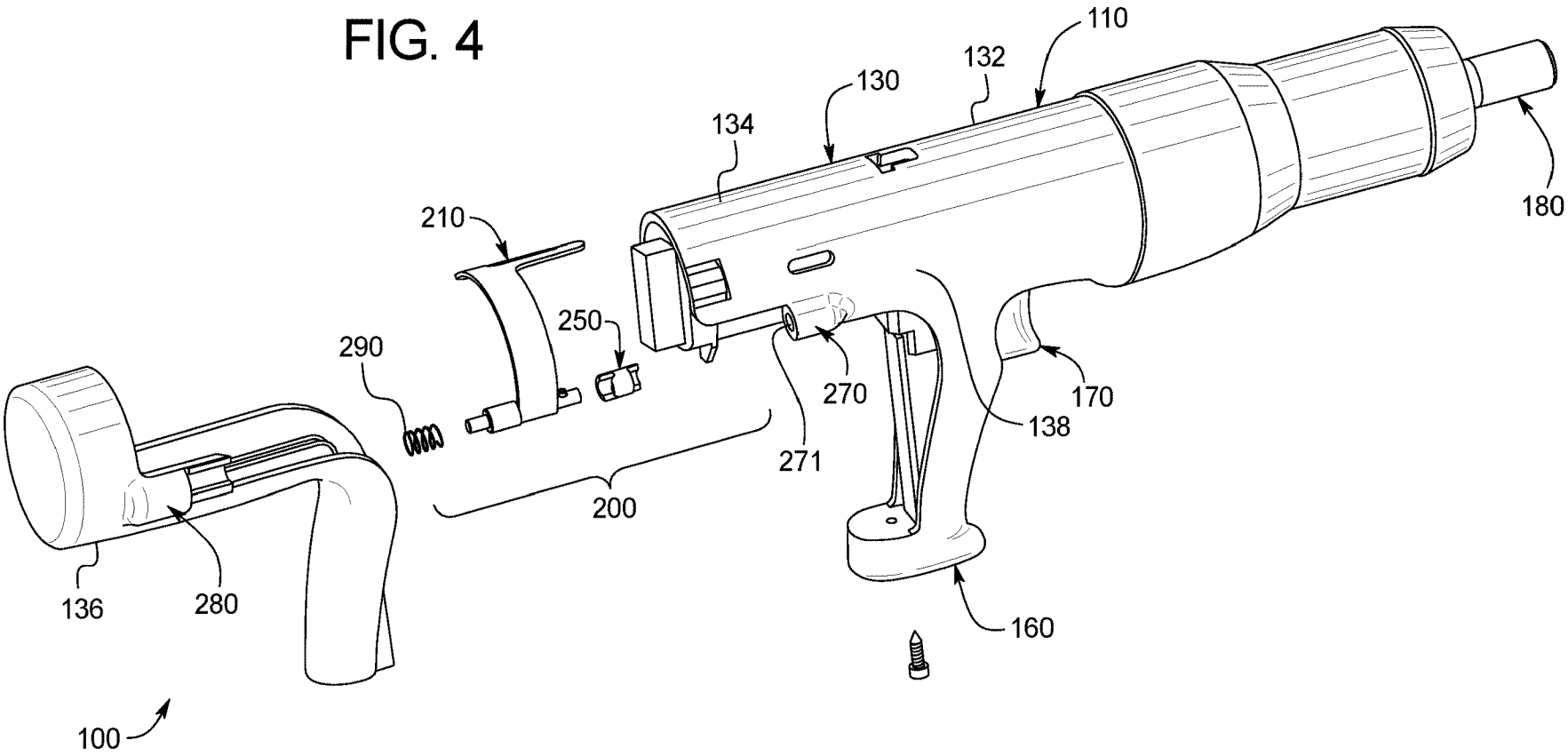
FIG. 4 is a right side partial exploded perspective view of the powder-actuated tool of FIG. 1, illustrating the pipe hook assembly including the pipe hook, the sleeve, the spring, the first or front sleeve receiver, and the second or rear receiver.
Figure 5:
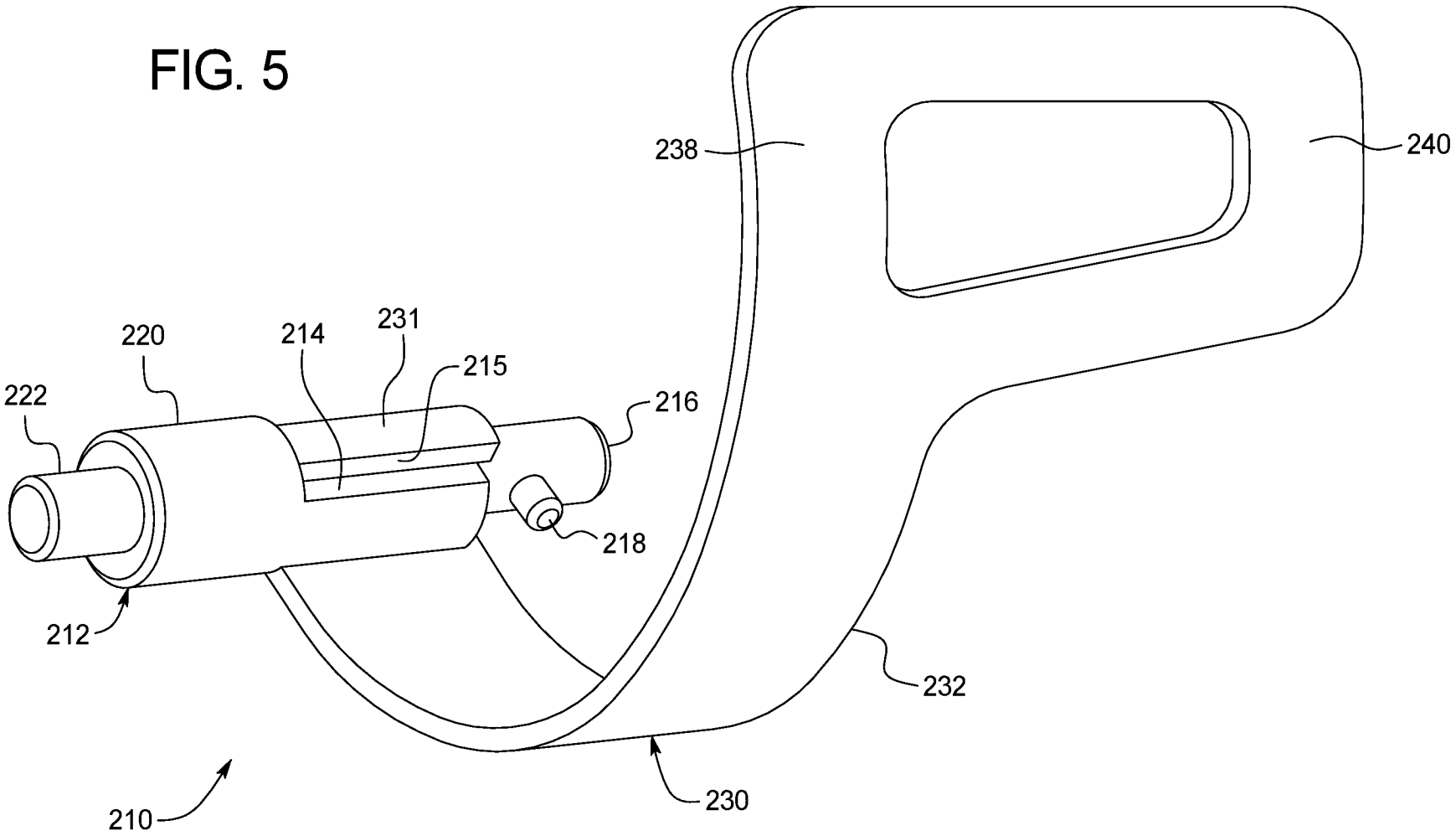
FIG. 5 is an enlarged side perspective view of the pipe hook of the pipe hook assembly of the powered fastener driving tool of FIG. 1.
Figure 6:
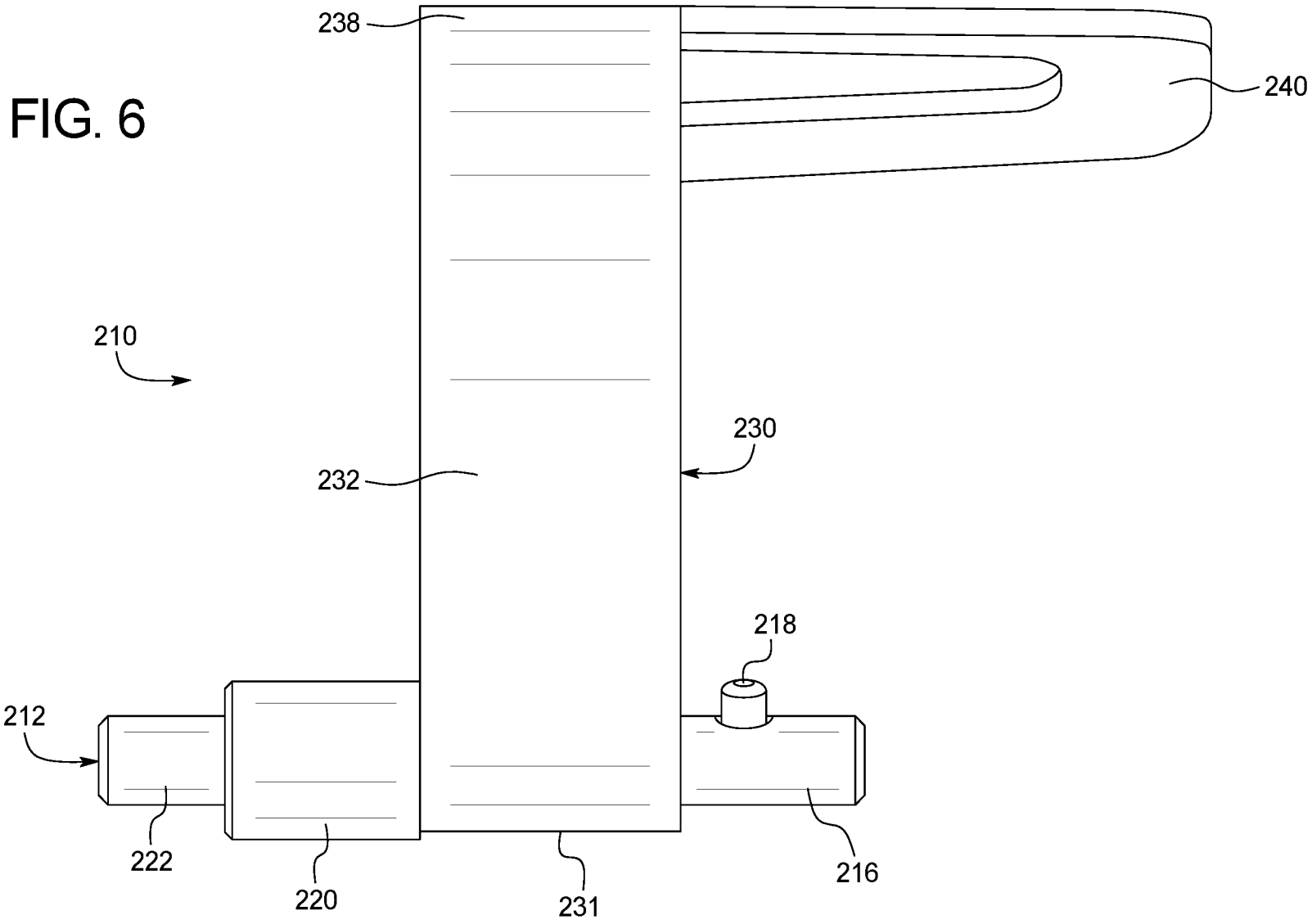
FIG. 6 is an enlarged side view of the pipe hook of the pipe hook assembly of the powered fastener driving tool of FIG. 1.
Figure 7:
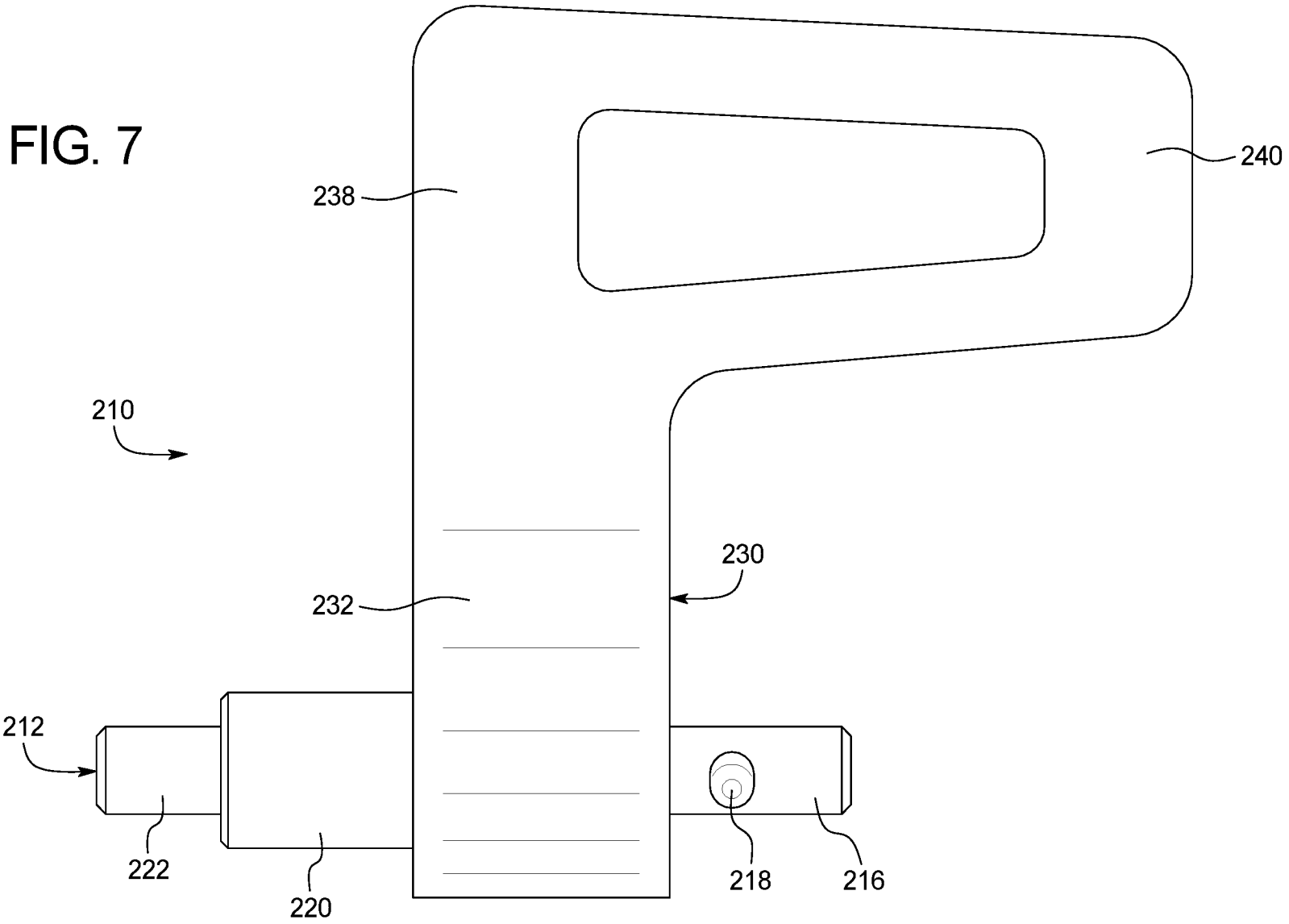
FIG. 7 is an enlarged side view of the pipe hook of the pipe hook assembly of the powered fastener driving tool of FIG. 1.
Figure 8:
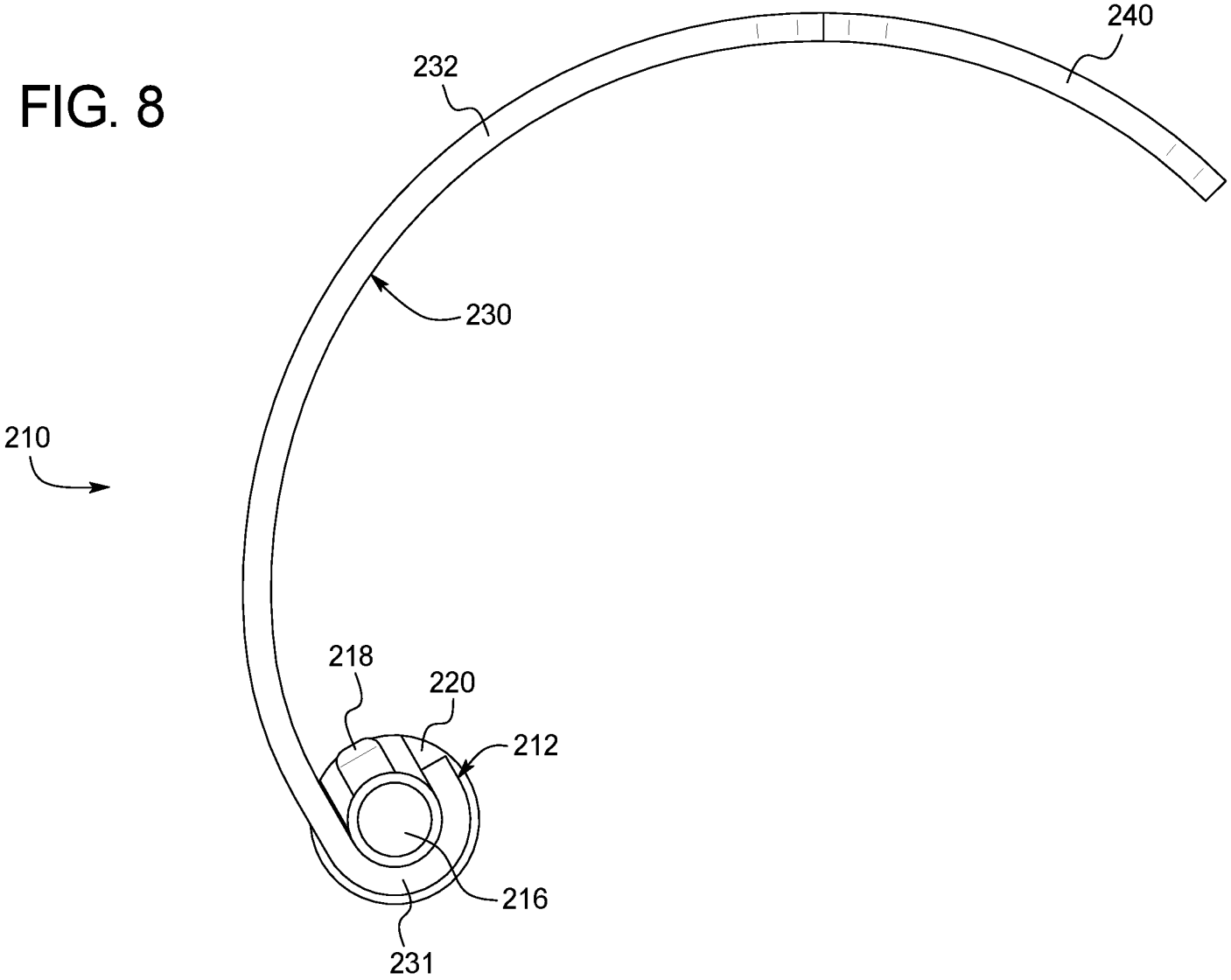
FIG. 8 is an enlarged end view of the pipe hook of the pipe hook assembly of the powered fastener driving tool of FIG. 1.
Figure 9:
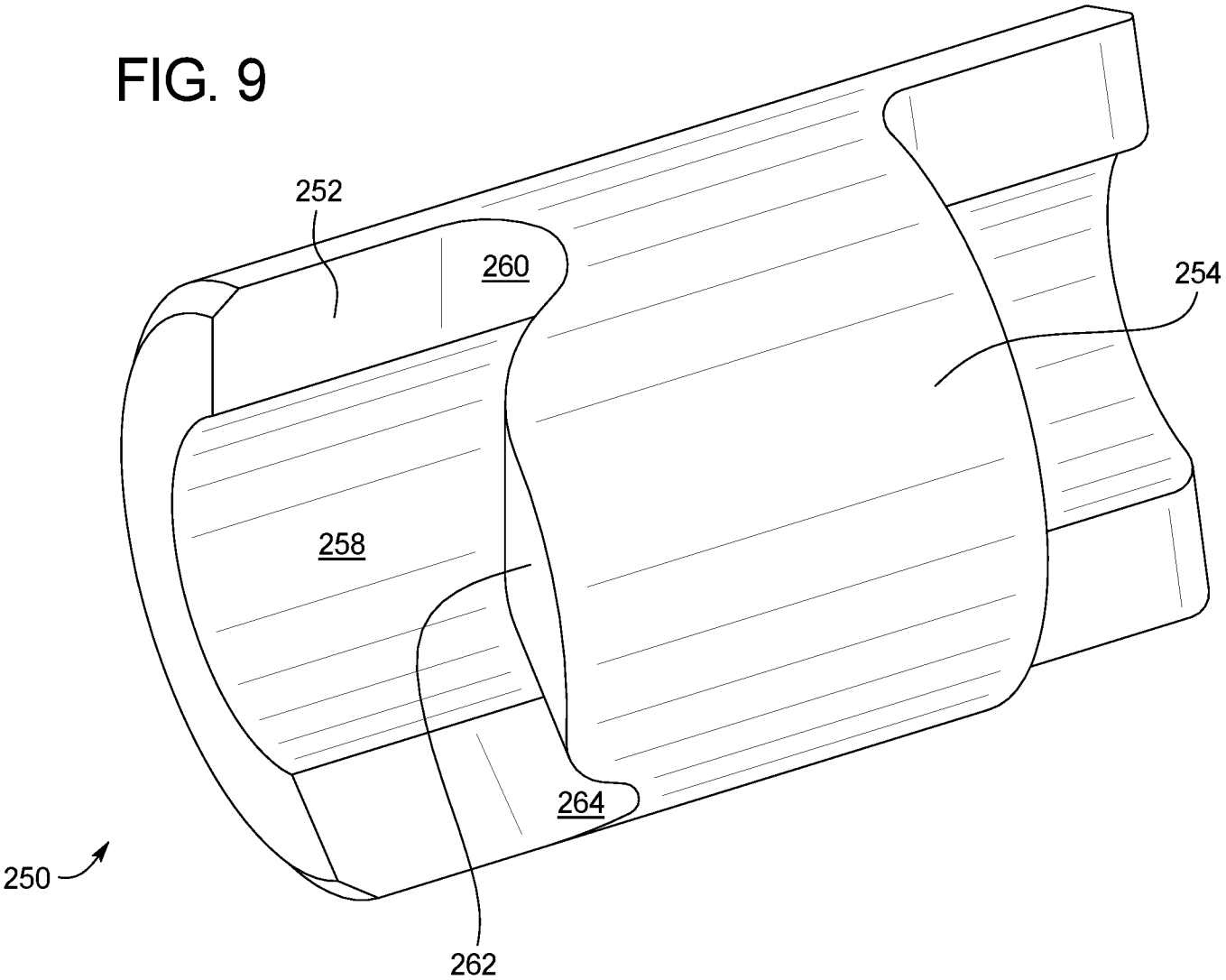
FIG. 9 is an enlarged side perspective view of the sleeve of the pipe hook assembly of the powered fastener driving tool of FIG. 1.
Figure 10:
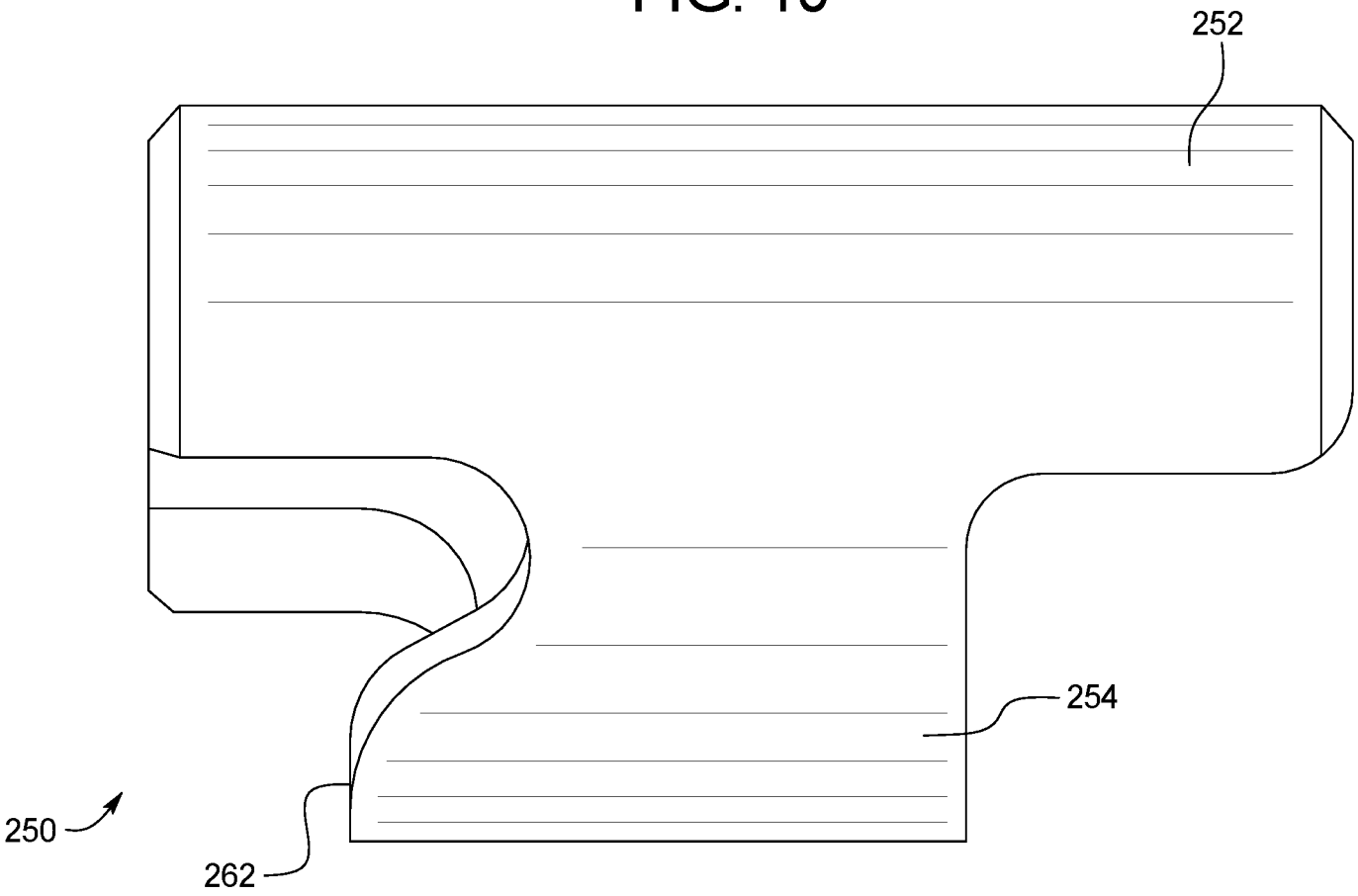
FIG. 10 is an enlarged top view of the sleeve of the pipe hook assembly of the powered fastener driving tool of FIG. 1.
Figure 11:
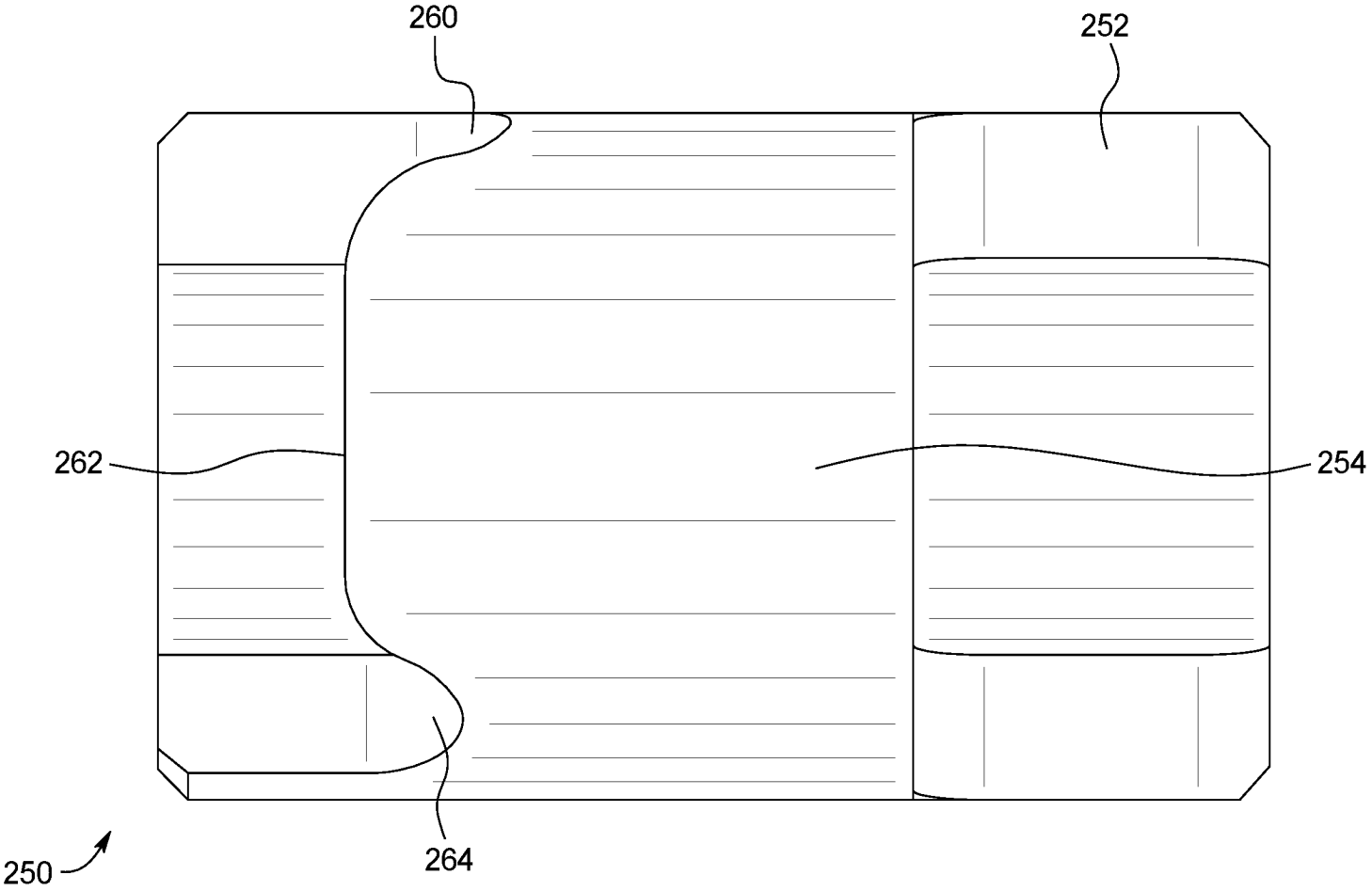
FIG. 11 is an enlarged side view of the sleeve of the pipe hook assembly of the powered fastener driving tool of FIG. 1.
Figure 12:
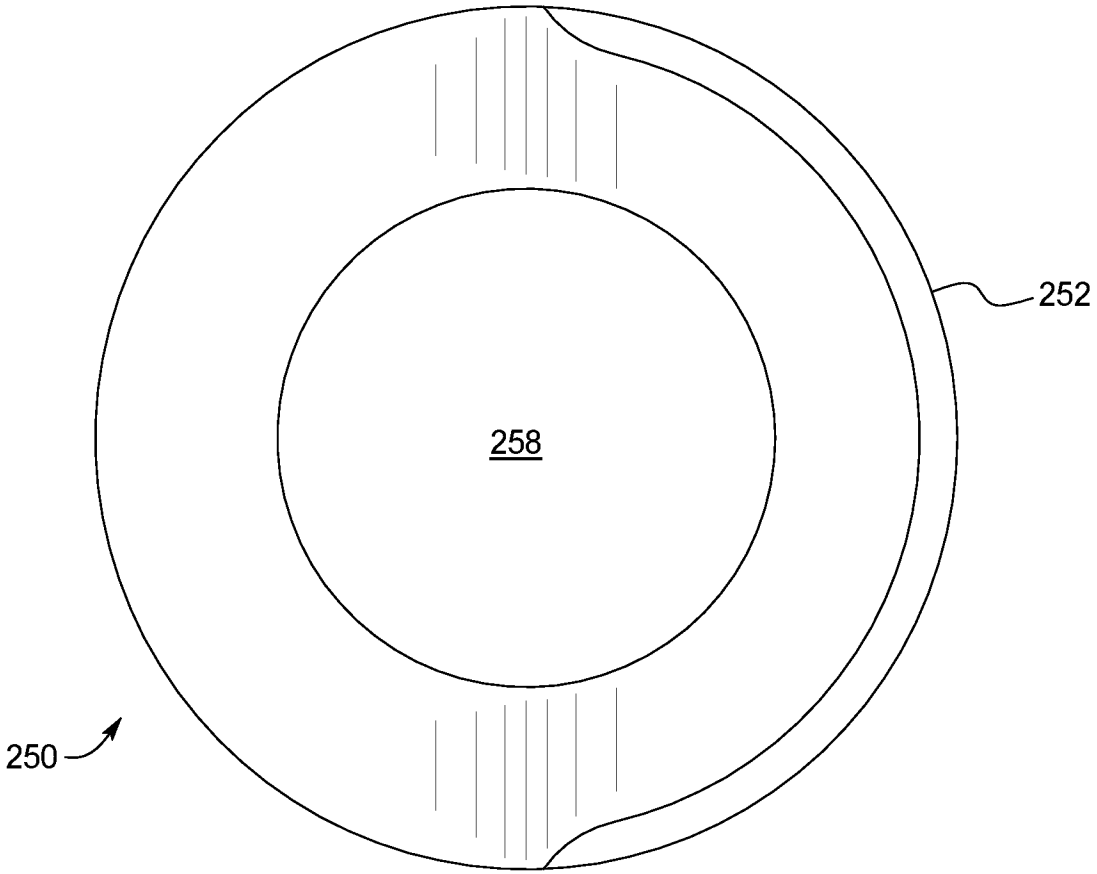
FIG. 12 is an enlarged end view of the sleeve of the pipe hook assembly of the powered fastener driving tool of FIG. 1.
Figure 14:
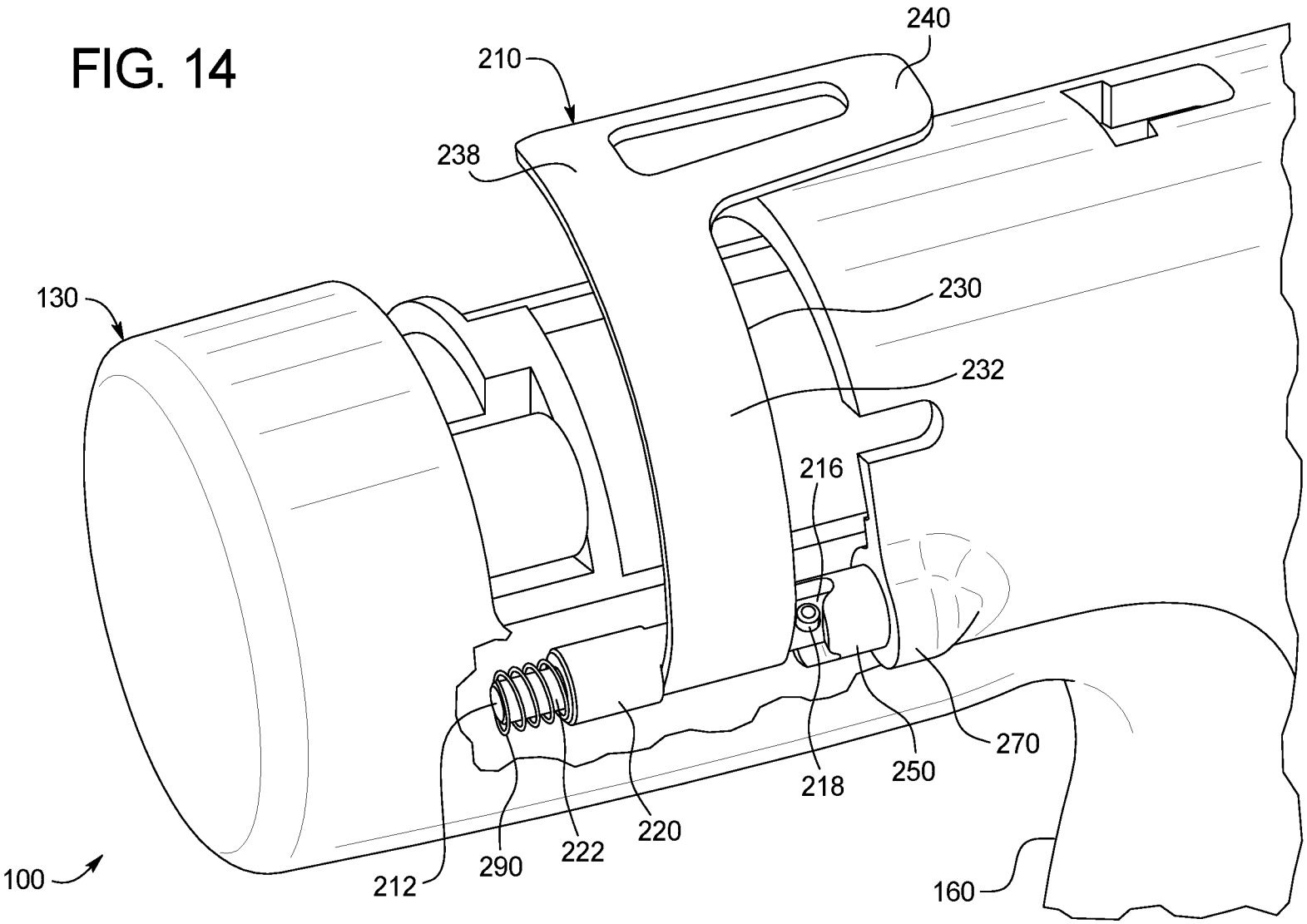
FIG. 14 is an enlarged fragmentary right side perspective view of the powder-actuated tool of FIG. 1, with part of the housing of the tool broken away and illustrating the pipe hook, the sleeve, and the spring of the pipe hook assembly, with the pipe hook in an intermediate position between the stored or retracted position and fully extended position.
Figure 15:
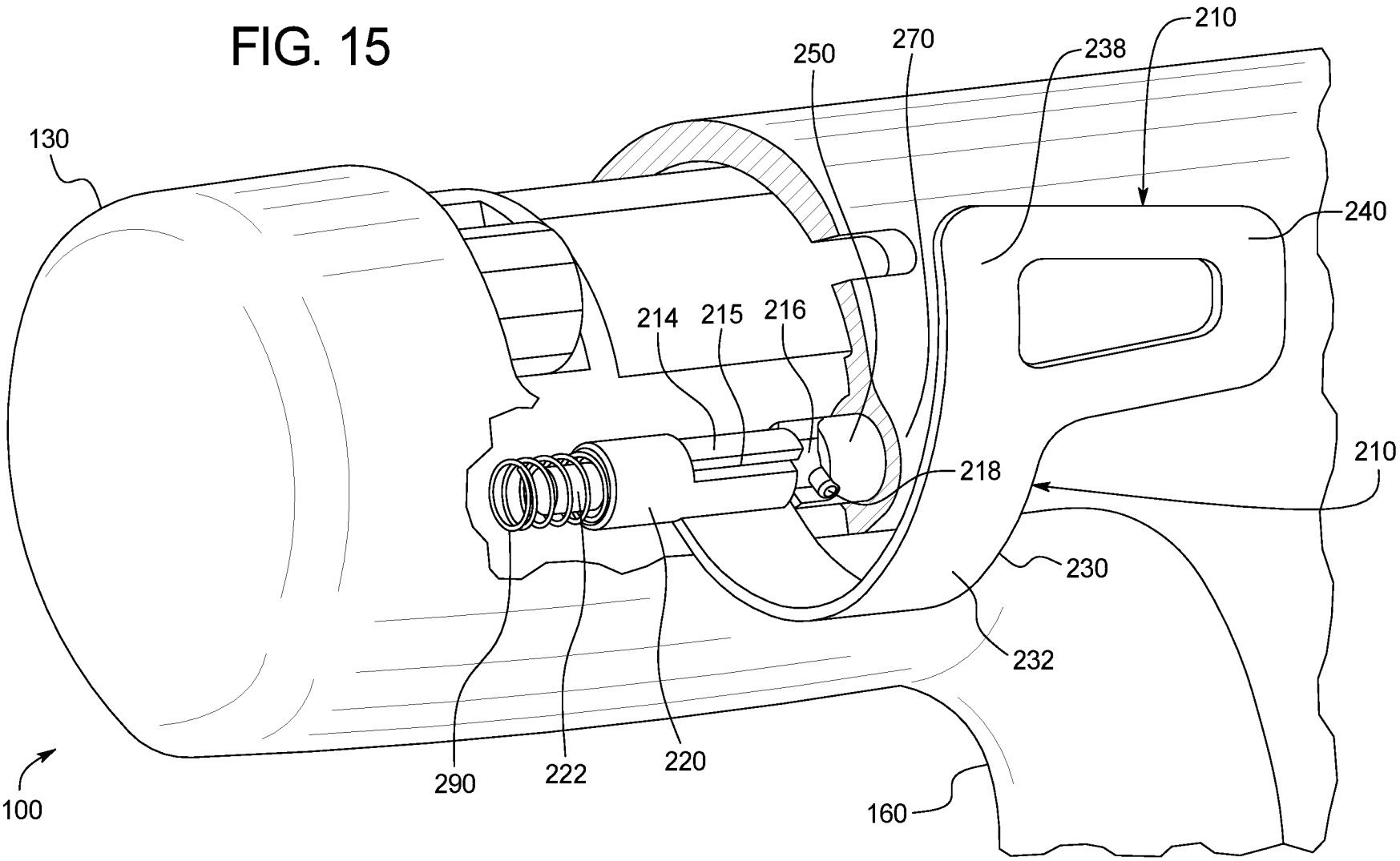
FIG. 15 is an enlarged fragmentary right side perspective view of the powder-actuated tool of FIG. 1, with part of the housing of the tool broken away and illustrating the pipe hook, the sleeve, and the spring of the pipe hook assembly, with the pipe hook in the fully extended position.
Figure 16:
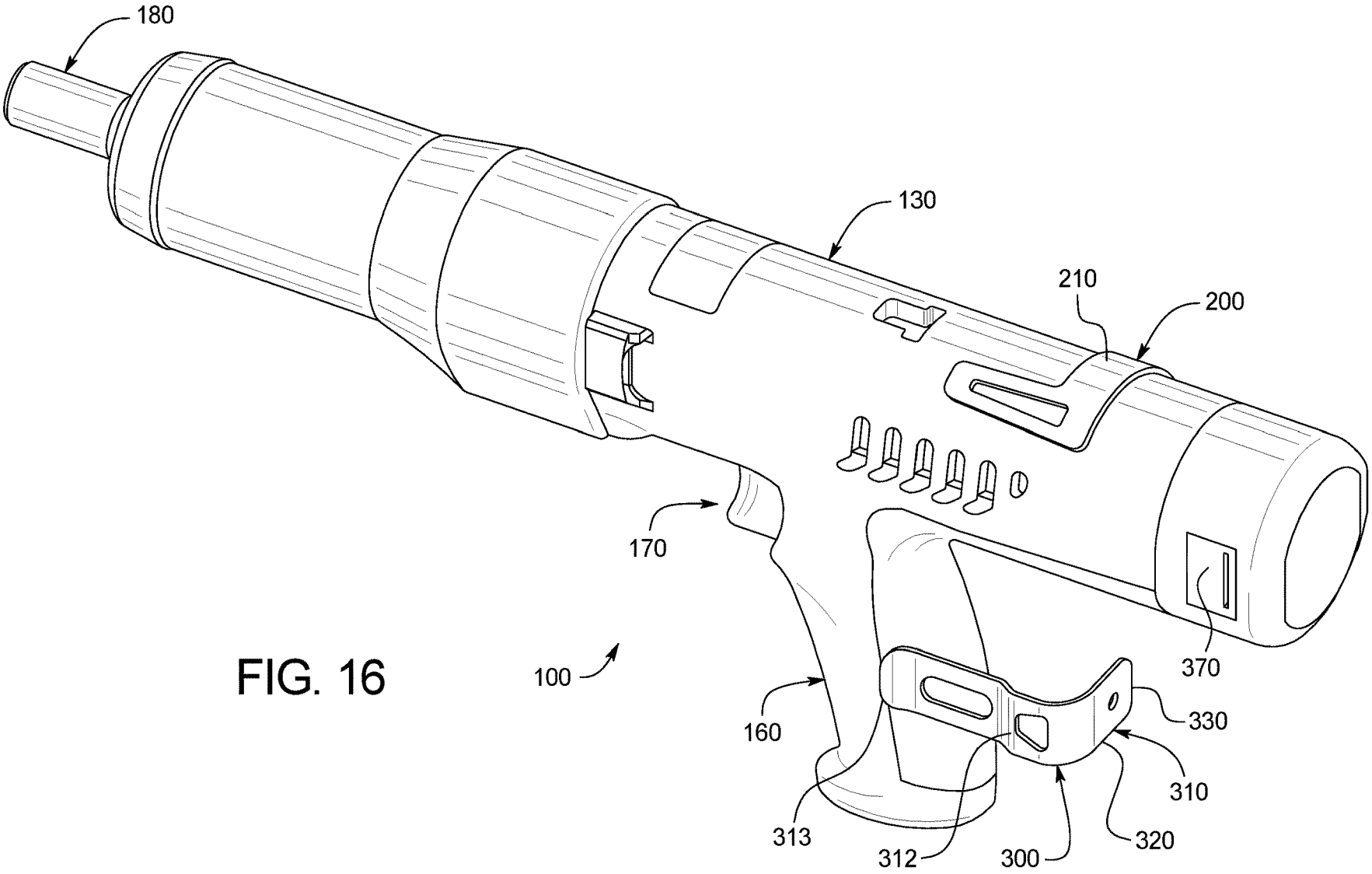
FIG. 16 is a left side partial exploded perspective view of the powder-actuated tool of FIG. 1, illustrating the belt hook of the belt hook assembly of the tool removed from the housing of the tool.

The first or front sleeve receiver 270 as best shown in FIGS. 3, 4, 14, and 15, is formed by and/or connected to and extends from the right side wall 138 of the main compartment assembly 130 of the housing assembly 110. The first or front sleeve receiver 270 defines a cylindrical chamber 271 that is configured to receive and securely hold the sleeve 250 as shown in FIGS. 13, 14, and 15. The second or rear receiver 280 as best shown in FIGS. 3 and 4, is formed by and or connected to and extends from the right side wall 138 of the main compartment assembly 130 of the housing assembly 110. The second or rear receiver 280 defines a cylindrical chamber (not shown) that is configured to receive the second rear shaft member 222 and the spring 290. The second or rear receiver 280 is configured to allow rotation of the second rear shaft member 222 relative to the main compartment assembly 130. It should also thus be appreciated that the pipe hook attachment shaft 212, the first or front sleeve receiver 270, the sleeve 250, and the second or rear receiver 280 are configured to allow rotation of the pipe hook attachment shaft 212 and the hooking arm 232 relative to the main compartment assembly 130 of the housing assembly 110.

The spring 290 as best shown in FIGS. 4, 13, 14, and 15, is a cylindrical metal coil spring configured to be journaled about the second rear shaft member 222 and positioned in the second or rear receiver 280. The spring 290 is configured to bias the second rear shaft member 222, and the entire pipe hook attachment shaft or hinge 212 in the forward direction or toward the first or front sleeve receiver 270. It should be appreciated that in alternative embodiments the pipe hook attachment shaft or hinge, the sleeve, the first receiver, the second receiver, and the spring can be alternatively configured (such as in a reverse configuration where the spring biases the pipe hook attachment shaft or hinge rearwardly) in accordance with the present disclosure.

The pipe hook attachment shaft 212, the pipe hook sleeve 250, the first or front sleeve receiver 270, the second or rear receiver 280, and the spring 290 co-act on work together to facilitate or enable movement or rotation of the pipe hook 210 and thus generally function together as a pipe hook rotation and locking assembly.

More particularly, the pipe hook 210 of the pipe hook assembly 200 is movably and, specifically, pivotally or rotatably connected to the housing 110 by this hook rotation and locking assembly and moveable from a first or stored or retracted position shown in FIGS. 1, 2, 3, and 13 to a plurality of intermediate positions such as intermediate position shown in FIG. 14, and then to a second or in-use or fully extended position shown in FIG. 15. Likewise, the pipe hook 210 of the pipe hook assembly 200 is movably and, specifically, pivotally or rotatably connected to the housing 110 by this hook rotation and locking assembly and moveable from the second or in-use or fully extended position shown in FIG. 15 back to the first or stored or retracted position shown in FIGS. 1, 2, 3, and 13. This hook rotation and locking assembly is also configured to lock the pipe hook 210 in the retracted position and in the fully extended position.

In the stored position, the spring 290 biases the pipe hook attachment shaft 212 forwardly such that the locking pin 218 is positioned in the slot 260 to prevent rotation of the pipe hook 210. At this point or position, the curved hook 230 and specifically the hooking arm 232 and the hooking hand 238 are positioned adjacent to or in engagement with the cylindrical generally tubular outer housing 132 of the main compartment assembly 130 and particularly the top wall 134 and the right side wall 138, such that the hook 230 is out of the way during use of the tool 100. It should be appreciated that the size and curvature of the pipe hook 210 generally matches or corresponds to the size and curvature of the generally tubular cylindrical outer housing 132 of the main compartment assembly 130 such that in the stored position, the pipe hook 210 wraps partially around, is foldable over, closely mates with, hugs, and engages the generally tubular cylindrical outer housing 132 as shown in FIGS. 1, 2, 3, 13, and 16.

To use the pipe hook 210, the user moves the pipe hook attachment shaft 212 rearwardly against the bias of the spring 290 and such that the locking pin 218 moves rearwardly out of the slot 260. At that point, the pipe hook 212 including the curved hook 230 can be rotated downwardly such that the hooking arm 232 and hooking hand 238 move outwardly away from the cylindrical generally tubular outer housing 132 of the main compartment assembly 130. In the intermediate positions during rotation, the locking pin 218 engages the wall 262 as shown in FIG. 14.

When the pipe hook attachment arm 212 and the hook 230 are rotated to the fully extended position, the spring 290 biases the pipe hook attachment shaft 212 forward such that the locking pin 218 moves into the slot 264 to lock the pipe hook 200 in the fully extended position as shown in FIG. 15. In this position, the user of the tool 100 can hang the tool 100 on a member such as a pipe (not shown) or scaffolding (not shown) when the tool 100 is temporarily not in use. In this fully extended position, the finger 240 assists in engaging the member (such as a pipe) that the tool 100 is hung on.

It should thus be appreciated that a user or operator of the tool 100 can easily and quickly move the pipe hook 210 of the pipe hook assembly 200 from the retracted locked position to the fully extended locked position (and back to the retracted locked position). Thus, the pipe hook assembly: (a) enables the pipe hook 210 to be stored in a retracted position adjacent to the housing 130 such that it does not interfere with operation of the tool 100; (b) substantially reduces the chance that the pipe hook 210 can get caught on or snagged on an object when not in use; (c) can easily be moved or rotated to the fully extended position to enable the operator to hang the tool 100 on an object besides the operator's belt such as scaffolding, pipes, and ladders without breaking and without falling off such objects; and (d) does not add significant weight to the tool 100, and thus minimizes operator fatigue.

It should also be appreciated from the above that the pipe hook 210 of the pipe hook assembly 200 extends out of the right side wall 138 of the tubular outer housing 132 near the bottom wall 136 and folds over the top wall 134 of the tubular outer housing 132.

In this illustrated example embodiment, the belt hook assembly 300 includes a belt hook 310 fixedly attached to a second or left side 218 of the housing assembly 110, and particularly the cylindrical generally tubular outer housing 132 of the main compartment assembly 130.

The belt hook assembly 300 generally includes: (a) a generally L-shaped belt hook 310 extending from the left side wall 142 of the main compartment assembly 130 of the housing assembly 110; and (b) a belt hook receiver 370 connected to or formed by or in the left side wall 142 of the main compartment assembly 130 of the housing assembly 110. In this illustrated example embodiment, (a) the belt hook 310 is made from a suitable metal; and (b) the belt hook receiver 370 is made from a suitable metal. These components are all relatively light in weight. It should be appreciated that these components can be made from other suitable materials in accordance with the present disclosure.

Figure 2:
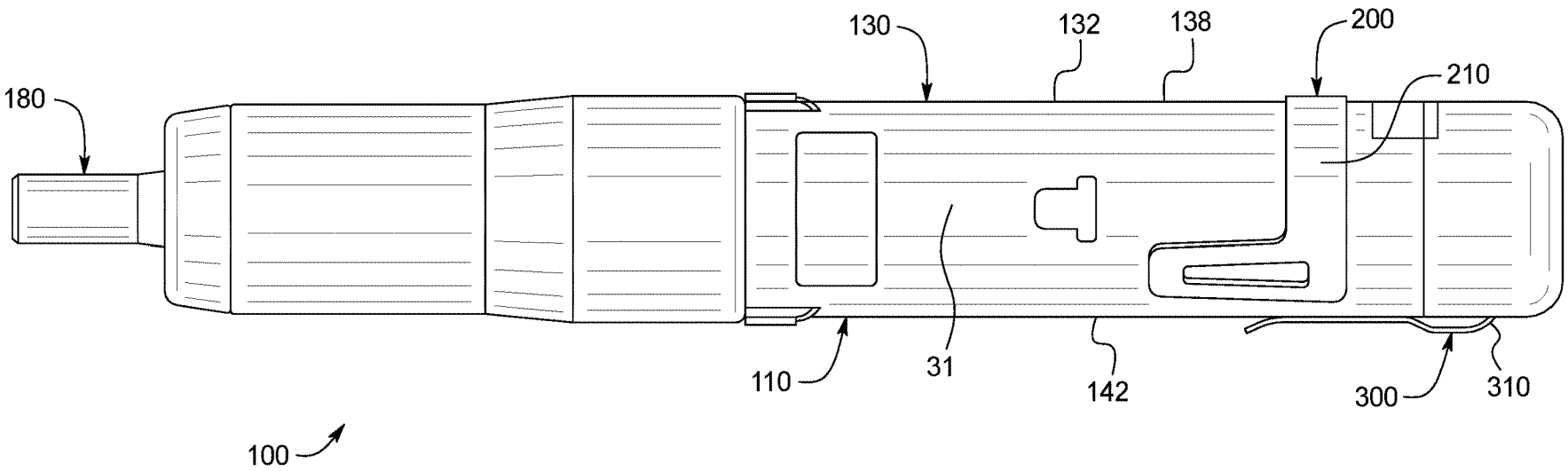
FIG. 2 is a top plan view of the powder-actuated tool of FIG. 1, illustrating the rotatable pipe hook of the pipe hook assembly of the tool in the stored or retracted position, and illustrating the belt hook of the belt hook assembly of the tool in the fixed retracted position.

More specifically, the belt hook 310 includes: (a) a hooking hand 312 having a hooking finger 313; and (b) a connection arm 320 integrally connected at one end to the hooking hand 312. The connection arm 320 includes an insertion end 330 at the end of the extension arm 320 opposite hooking hand 312. The connection arm 320 is configured to be inserted into (during assembly) and securely fixed to, locked in or to, or securely held by the belt hook receiver 370 such that the hooking finger 313 of the hooking hand 312 engages the second or left side wall 142 of the outer housing 132 as shown in FIGS. 1 and 2. It should also be appreciated that this configuration provides a natural bias of the hooking hand 312 toward the generally tubular cylindrical outer housing 132 as shown in FIGS. 1 and 2. The belt hook 310 is flexible enough to allow a belt strap to be positioned between the hooking hand 312 of the belt hook 310 and the housing 132.

One or both of the connection arm 320 and the belt hook receiver 370 have one or more suitable locking mechanisms that securely connect the connection arm 320 in the belt hook receiver 370 in the position shown in FIGS. 1 and 2. In this illustrated example embodiment, the connection arm 320 includes an opening through which a fastener (not shown) can extend to secure the connection arm 320 and the entire belt hook 310 to the belt hook receiver 370 and the main compartment assembly 130 of the tool 100.

This belt hook assembly 300 enables a user or operator to hang the tool on the user or operator's belt. Thus, the belt hook assembly 300: (a) does not interfere with operation of the tool 100; (b) substantially reduces the chance that the belt hook can get caught on or snagged on an object; and (c) does not add significant weight to the tool, and thus minimizes operator fatigue.

Figure 17:
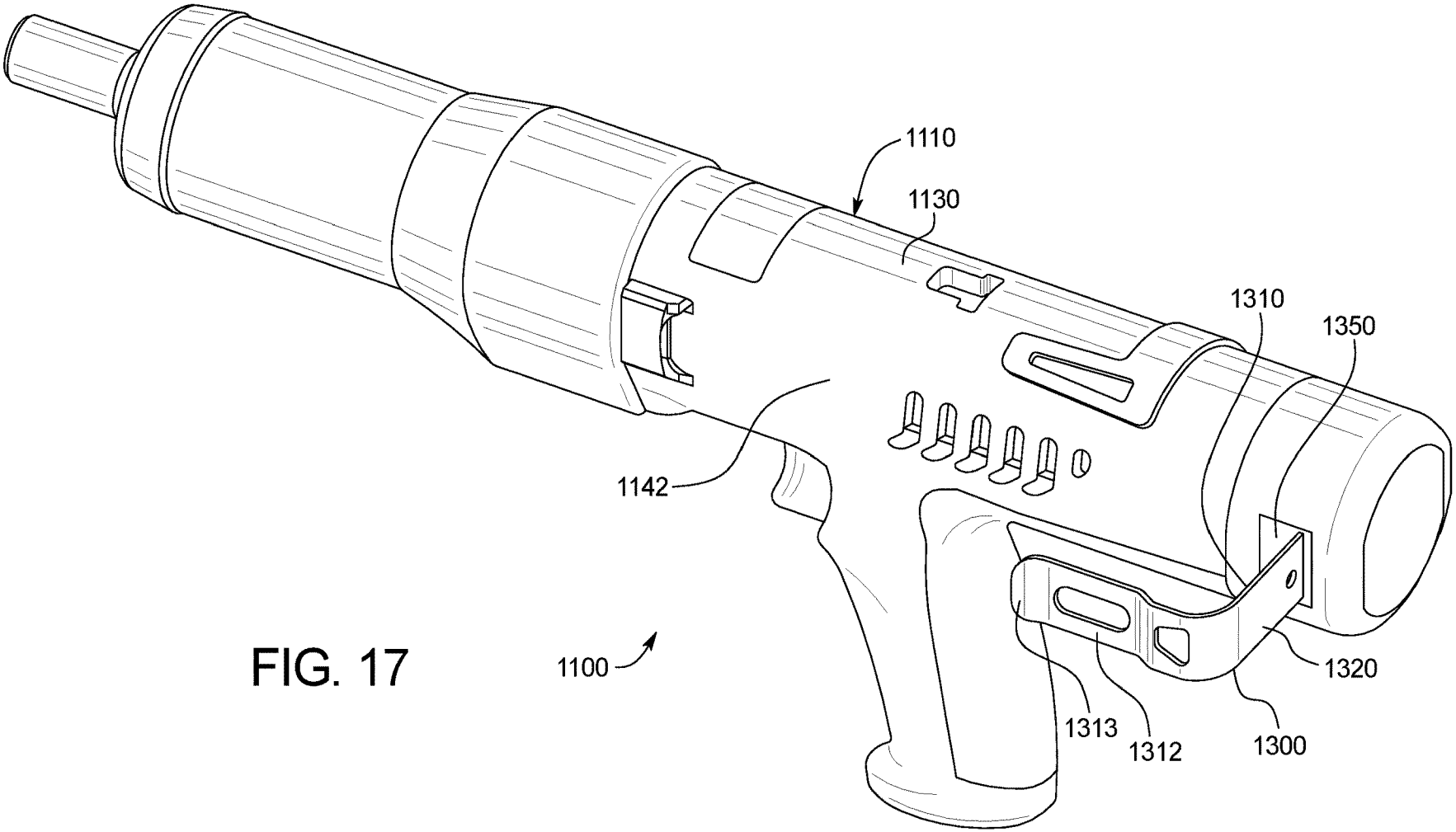
FIG. 17 is a left side perspective view of a powder-actuated tool of another example embodiment of the present disclosure, illustrating the pipe hook assembly of the tool with the rotatable pipe hook in a stored position, and illustrating the belt hook assembly of the tool attached to the housing and with the belt hook in an extended position.
Figure 18:
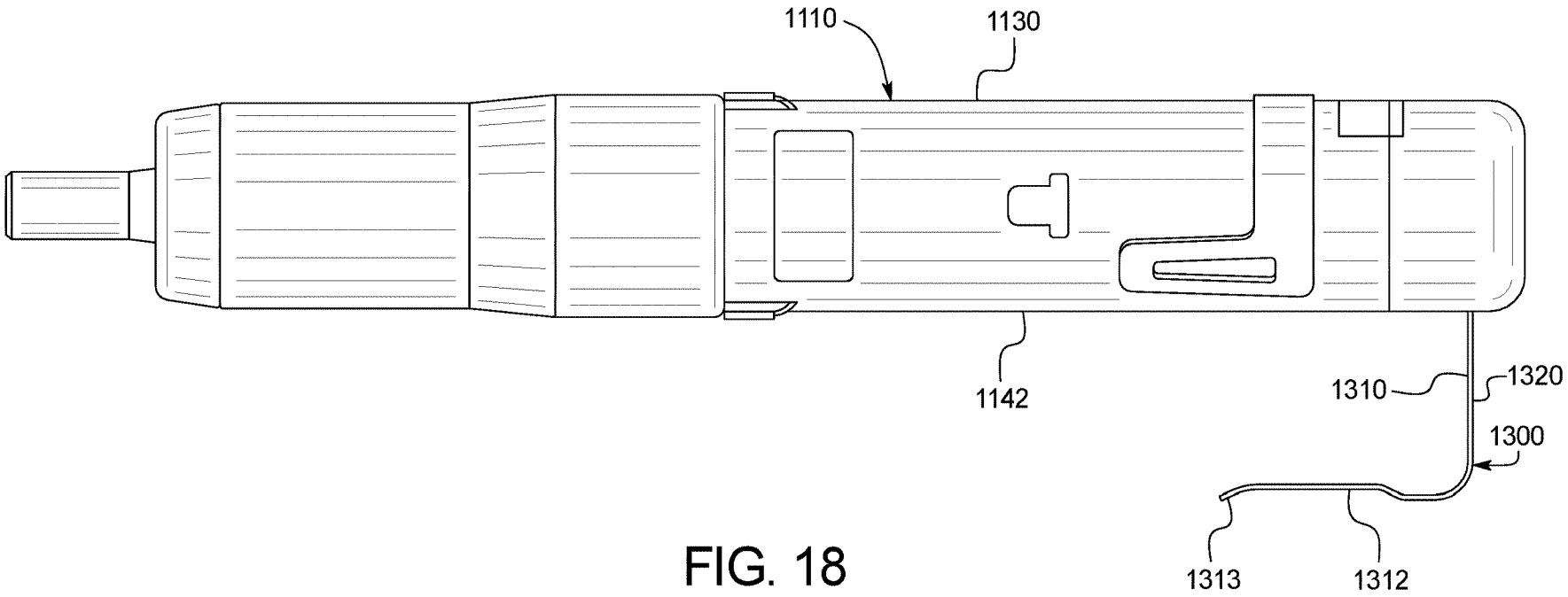
FIG. 18 is a top view of a powder-actuated tool of FIG. 17, illustrating the pipe hook assembly of the tool with the rotatable pipe hook in a stored position, and illustrating the belt hook assembly of the tool attached to the housing and with the belt hook in an extended position.

FIGS. 17 and 18 illustrate an alternative example embodiment of the present disclosure. In this illustrated example embodiment, the belt hook assembly 1300 generally includes: (a) a generally L-shaped belt hook 1310 extending from the left side wall 1142 of the main compartment assembly 1130 of the housing assembly 1110; and (b) a belt hook receiver 1350 connected to or formed by or in the left side wall 1142 of the main compartment assembly 1130 of the housing assembly 1110. In this illustrated alternative example embodiment, the belt hook 1310 of the belt hook assembly 1300 is moveably secured to the housing 1110. In this illustrated example embodiment: (a) the belt hook 1310 is made from a suitable metal; and (b) the belt hook receiver 1350 is made from a suitable metal. It should be appreciated that these components can be made from other suitable materials in accordance with the present disclosure.

More specifically, the belt hook 1310 includes: (a) a hooking hand 1312 having a hooking finger 1313; and (b) a connection arm 1320 integrally connected at one end to the hooking hand 1312. The connection arm 1320 includes an insertion end (not shown) at the end of the extension arm 1320 opposite hooking hand 1312. The connection arm 1320 is configured to be moveably inserted into the belt hook receiver 1350 such that the hooking finger 1313 of the hooking hand 1312 engages the second or left side wall 1142 of the outer housing in a retracted position and is spaced from the outer housing in an extended position as shown in FIGS. 17 and 18. In such embodiments, one or both of the connection arm 1320 and the belt hook receiver 1350 have one or more suitable mechanisms (not shown) that movably connect the connection arm 1320 in the belt hook receiver 1350.

It should be appreciated from the above, that the present disclosure provides a powered fastener driving tool comprising: a housing assembly including a main compartment assembly and a handle assembly extending from the main compartment assembly; a pipe hook assembly including a pipe hook rotatably attached to a first side of the main compartment assembly of the housing assembly; and a different belt hook assembly including a belt hook attached to a second opposite side of the main compartment assembly housing assembly.

In various such embodiments of the powered fastener driving tool, the pipe hook extends from the first side of the main compartment assembly.

In various such embodiments of the powered fastener driving tool, the pipe hook is foldable over a top wall of the main compartment assembly.

In various such embodiments of the powered fastener driving tool, the pipe hook is foldable over a top wall of the main compartment assembly.

In various such embodiments of the powered fastener driving tool, the pipe hook assembly includes a sleeve, a first sleeve receiver, a second receiver, and a spring.

In various such embodiments of the powered fastener driving tool, the pipe hook includes a multi-section pipe hook attachment shaft and an at least partially curved hook connected to and extending from the pipe hook attachment shaft.

In various such embodiments of the powered fastener driving tool, the pipe hook attachment shaft includes a central shaft member, a front shaft member connected to and extending from the central shaft member, a locking pin connected to and extending transversely from the front shaft member, a first rear shaft member connected to and extending from the central shaft member, and a second rear shaft member connected to and extending from the first rear shaft member.

In various such embodiments of the powered fastener driving tool, the hook includes a hooking base connected to the central shaft member, a hooking arm connected and extending from the hooking base, a hooking hand connected to the hooking arm.

In various such embodiments of the powered fastener driving tool, the hooking hand includes a transversely extending hooking finger.

In various such embodiments of the powered fastener driving tool, the sleeve includes a generally cylindrical tubular body that defines a first locking pin receiving slot and a spaced apart second locking pin receiving slot.

In various such embodiments of the powered fastener driving tool, in a stored position, the spring biases the pipe hook attachment shaft such that the locking pin is positioned in the first locking pin receiving slot to prevent rotation of the pipe hook.

In various such embodiments of the powered fastener driving tool, in a fully extended position, the spring biases the pipe hook attachment shaft such that the locking pin is positioned in the second slot to prevent rotation of the pipe hook.

In various such embodiments of the powered fastener driving tool, the pipe hook is movable from a retracted position to a plurality of intermediated positions to a fully extended position.

In various such embodiments of the powered fastener driving tool, the belt hook assembly includes a generally L-shaped belt hook, and a belt hook receiver.

In various such embodiments of the powered fastener driving tool, the belt hook includes a hooking hand having a hooking finger and a connection arm connected at one end to the hooking hand.

In various such embodiments of the powered fastener driving tool, the connection arm is inserted into and securely fixed to the belt hook receiver.

In various such embodiments of the powered fastener driving tool, the connection arm is inserted into and movable in the belt hook receiver.

It will be understood that modifications and variations may be effected without departing from the scope of the novel concepts of the present invention, and it is understood that this application is to be limited only by the scope of the claims.

The invention is claimed as follows:

1. A powered fastener driving tool comprising:

a housing assembly including a main compartment assembly and a handle assembly extending transversely from the main compartment assembly, the main compartment assembly including a tubular outer housing including a top wall, a bottom wall, a first side wall, a second side wall, a front end, and a rear end;

a pipe hook assembly including: (a) a pipe hook rotatably attached to the first side wall of the tubular outer housing of the main compartment assembly of the housing assembly, the pipe hook including (i) a multi-section pipe hook attachment shaft, (ii) an at least partially curved hooking arm connected to and extending from the pipe hook attachment shaft, (iii) a hooking hand connected to the hooking arm, wherein the pipe hook attachment shaft includes a central shaft member, a front shaft member connected to and extending from the central shaft member, a locking pin connected to and extending transversely from the front shaft member, a first rear shaft member connected to and extending from the central shaft member, and a second rear shaft member connected to and extending from the first rear shaft member, the pipe hook rotatable from a retracted position to a fully extended position, wherein in the retracted position the hooking arm and the hooking hand are adjacent to the tubular outer housing, and wherein in the fully extended position the hooking arm extends outwardly from the tubular body, the hooking hand is spaced from the tubular body, and the hooking hand extends in a same direction as the front end of the tubular outer housing, and (b) including a sleeve, a first sleeve receiver attached to the first side wall of the tubular outer housing, a second receiver attached to the first side wall of the tubular outer housing, and a spring; and a different belt hook assembly including a belt hook attached to the second side wall of the tubular outer housing of the main compartment assembly housing assembly.

2. The powered fastener driving tool of claim 1, wherein the pipe hook is foldable over the top wall of the tubular outer housing of the main compartment assembly.

3. The powered fastener driving tool of claim 1, wherein the pipe hook is rotatable over the top wall of the tubular outer housing of the main compartment assembly.

4. The powered fastener driving tool of claim 1, wherein the pipe hook includes a hooking base connected to the central shaft member, and the hooking arm connected and extending from the hooking base.

5. The powered fastener driving tool of claim 4, wherein the hooking hand includes a transversely extending hooking finger.

6. The powered fastener driving tool of claim 4, wherein the pipe hook is rotatable from the retracted position to a plurality of intermediated positions to the fully extended position.

7. The powered fastener driving tool of claim 1, wherein the sleeve includes a generally cylindrical tubular body that defines a first locking pin receiving slot and a spaced apart second locking pin receiving slot.

8. The powered fastener driving tool of claim 7, wherein in the retracted position, the spring biases the pipe hook attachment shaft such that the locking pin is positioned in the first locking pin receiving slot to prevent rotation of the pipe hook.

9. The powered fastener driving tool of claim 7, wherein in the fully extended position, the spring biases the pipe hook attachment shaft such that the locking pin is positioned in the second slot to prevent rotation of the pipe hook.

10. The powered fastener driving tool of claim 1, wherein the belt hook assembly includes a generally L-shaped belt hook, and a belt hook receiver.

11. The powered fastener driving tool of claim 10, wherein the belt hook includes a hooking hand having a hooking finger and a connection arm connected at one end to the hooking hand.

12. The powered fastener driving tool of claim 11, wherein the connection arm is inserted into and securely fixed to the belt hook receiver.

13. The powered fastener driving tool of claim 11, wherein the connection arm is inserted into and movable in the belt hook receiver.

14. A powered fastener driving tool comprising:

a housing assembly including a main compartment assembly and a handle assembly extending transversely from the main compartment assembly, the main compartment assembly including a tubular outer housing including a top wall, a bottom wall, a first side wall, a second side wall, a front end, and a rear end; and a pipe hook assembly including: (a) a pipe hook rotatably attached to the first side wall of the tubular outer housing of the main compartment assembly of the housing assembly, the pipe hook including (i) a multi-section pipe hook attachment shaft, (ii) an at least partially curved hooking arm connected to and extending from the pipe hook attachment shaft, (iii) a hooking hand connected to the hooking arm, wherein the pipe hook attachment shaft includes a central shaft member, a front shaft member connected to and extending from the central shaft member, a locking pin connected to and extending transversely from the front shaft member, a first rear shaft member connected to and extending from the central shaft member, and a second rear shaft member connected to and extending from the first rear shaft member, the pipe hook rotatable from a retracted position to a fully extended position, wherein in the retracted position the hooking arm and the hooking hand are adjacent to the tubular outer housing, and wherein in the fully extended position the hooking arm extends outwardly from the tubular body, the hooking hand is spaced from the tubular body, and the hooking hand extends in a same direction as the front end of the tubular outer housing, and (b) including a sleeve, a first sleeve receiver attached to the first side wall of the tubular outer housing, a second receiver attached to the first side wall of the tubular outer housing, and a spring.

15. A powered fastener driving tool comprising:

a housing assembly including a main compartment assembly and a handle assembly extending from the main compartment assembly; and a pipe hook assembly including a pipe hook rotatably attached to a first side of the main compartment assembly of the housing assembly, the pipe hook assembly including a sleeve, a first sleeve receiver, a second receiver, and a spring, the pipe hook including a multi-section pipe hook attachment shaft and an at least partially curved hook connected to and extending from the pipe hook attachment shaft, the pipe hook attachment shaft including a central shaft member, a front shaft member connected to and extending from the central shaft member, a locking pin connected to and extending transversely from the front shaft member, a first rear shaft member connected to and extending from the central shaft member, and a second rear shaft member connected to and extending from the first rear shaft member.

16. The powered fastener driving tool of claim 15, wherein the hook includes a hooking base connected to the central shaft member, a hooking arm connected and extending from the hooking base, a hooking hand connected to the hooking arm.

17. The powered fastener driving tool of claim 16, wherein the hooking hand includes a transversely extending hooking finger.

* * * * *